US009541325B2

(12) United States Patent
Sato et al.

(10) Patent No.: US 9,541,325 B2
(45) Date of Patent: Jan. 10, 2017

(54) REFRIGERATOR AND INFORMATION SYSTEM

(71) Applicant: Panasonic Corporation, Kadoma-shi, Osaka (JP)

(72) Inventors: Fumiaki Sato, Shiga (JP); Yoshito Kimura, Shiga (JP); Masakazu Hoashi, Shiga (JP); Yasuhiro Tsujii, Osaka (JP); Yasuyuki Okamoto, Shiga (JP); Osamu Ueno, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 274 days.

(21) Appl. No.: 14/372,952

(22) PCT Filed: Feb. 15, 2013

(86) PCT No.: PCT/JP2013/000826

§ 371 (c)(1),
(2) Date: Jul. 17, 2014

(87) PCT Pub. No.: WO2013/136665

PCT Pub. Date: Sep. 19, 2013

(65) Prior Publication Data

US 2015/0000316 A1 Jan. 1, 2015

(30) Foreign Application Priority Data

Mar. 13, 2012 (JP) ..... 2012-055562
Mar. 13, 2012 (JP) ..... 2012-055563
May 15, 2012 (JP) ..... 2012-111236

(51) Int. Cl.
*F25B 41/00* (2006.01)
*F25D 23/00* (2006.01)
*F25D 29/00* (2006.01)

(52) U.S. Cl.
CPC ..... *F25D 23/00* (2013.01); *F25D 29/00* (2013.01); *F25D 2400/361* (2013.01); *F25D 2500/04* (2013.01); *F25D 2700/02* (2013.01)

(58) Field of Classification Search
CPC .... F25D 2700/02; F25D 29/00; F25D 23/003; F25D 23/061; A47F 3/0495
(Continued)

(56) References Cited

U.S. PATENT DOCUMENTS 6,131,400 A 10/2000 Seok et al.
6,729,147 B2 5/2004 Lee
(Continued)

FOREIGN PATENT DOCUMENTS

CN 1247969 3/2000
CN 1257184 6/2000
(Continued)

OTHER PUBLICATIONS

English Translation of Chinese Search Report dated Sep. 21, 2015 for the related Chinese Patent Application No. 2013800138886.
(Continued)

*Primary Examiner* — Melvin Jones
(74) *Attorney, Agent, or Firm* — Hamre, Schumann, Mueller & Larson, P.C.

(57) ABSTRACT

A refrigerator includes energy-saving operation unit that performs a control for performing a power saving operation, time measurement unit that measures an operation time of energy-saving operation unit, and energy-saving operation rate calculation unit that calculates an energy-saving operation rate based on the operation time measured by time measurement unit. The refrigerator further includes an energy-saving operation rate storage unit that stores the energy-saving operation rate calculated by energy-saving operation rate calculation unit.

10 Claims, 27 Drawing Sheets

(58) Field of Classification Search
USPC ..... 62/131, 231, 440
See application file for complete search history.

(56) References Cited

U.S. PATENT DOCUMENTS

| | | | | |
|---|---|---|---|---|
| 6,732,319 | B2 * | 5/2004 | Holmes | G11C 7/20 714/764 |
| 7,634,918 | B2 * | 12/2009 | Kawaguchi | F25B 49/022 62/126 |
| 2008/0161024 | A1 | 7/2008 | Sawaki et al. | |

FOREIGN PATENT DOCUMENTS

| | | |
|---|---|---|
| CN | 101498539 | 8/2009 |
| JP | 9-107325 | 4/1997 |
| JP | 2002-107025 | 4/2002 |
| JP | 2002-147932 | 5/2002 |
| JP | 2003-050078 | 2/2003 |
| JP | 2003-130536 | 5/2003 |
| JP | 2003-174382 | 6/2003 |
| JP | 2005-076958 | 3/2005 |
| JP | 2006-272596 | 10/2006 |
| JP | 2008-166986 | 7/2008 |
| JP | 2008-275267 | 11/2008 |
| JP | 2010-224834 | 10/2010 |
| JP | 2011-027432 | 2/2011 |
| JP | 2011-208907 | 10/2011 |
| JP | 2007-292421 | 11/2011 |
| WO | 2010/031012 | 3/2010 |

OTHER PUBLICATIONS

The Extended European Search Report dated Aug. 5, 2015 for the related European Patent Application No. 13761658.7.

* cited by examiner

2190

REFRIGERATOR AND INFORMATION SYSTEM

TECHNICAL FIELD

The present invention relates to a refrigerator, particularly to a refrigerator with high energy-saving properties, and an information system in which the refrigerator is used.

BACKGROUND ART

Generally, a refrigerator accounts for a high rate of power consumption at home, and it is strongly required to reduce the power consumption as much as possible. In order for this, a refrigerator is proposed, which allows a power-saving operation using a light sensor or a door opening and closing detection switch.

For example, in a case where the light sensor detects that an external illuminance is equal to or higher than a predetermined illuminance, the refrigerator performs an ordinary operation. On the other hand, when the light sensor detects that the external illuminance is lower than a predetermined illuminance, the refrigerator determines that the customer has gone to bed and there is almost no possibility of opening the door of the refrigerator, and thus, performs a power-saving operation in which the refrigerator is operated by a power lower than the ordinary power, that is an energy-saving operation (for example, refer to PTL 1).

FIG. 24 is a flow chart for explaining a control of a refrigerator in the related art.

As illustrated in FIG. 24, when a switch for the energy-saving operation is pressed, the light sensor detects (S401) the illuminance around the front side of the refrigerator and calculates an illuminance changing rate (S402).

Next, the light sensor determines whether or not the changing rate is an increasing rate, and whether or not the changing rate is equal to or higher than a pre-set value, for example, equal to or higher than 150 lux/sec (S403). In a case where the changing rate is equal to or higher than the pre-set value, the ordinary operation is performed (S404), and in a case where the changing rate is not equal to or higher than the pre-set value, an illuminance decreasing rate is determined whether or not to be equal to or higher than the pre-set value (S405). In a case where the decreasing rate is equal to or higher than the pre-set value, the power-saving operation is performed (S406), and in a case where the decreasing rate is not equal to or higher than the pre-set value, the process returns to S401 and the illuminance detection is performed again.

By the refrigerator in the related art like this, it is possible to perform the power-saving operation that is the energy-saving operation not only in the night time but also in a case of dimmed lighting. Therefore, it is possible to perform an effective energy-saving operation.

On the other hand, in recent years, a power shortage due to the stoppage of the nuclear power plant resulting from a safety review has come to be a concern. For this reason, the power-saving consciousness of the user has extremely increased.

From this point of view, considering the method of using various electric apparatuses such as a refrigerator, the user has also come to take a power-saving action such that the electric apparatus performs a power-saving operation as much as possible. In the refrigerator also, in addition to an automatic energy-saving operation performed by the refrigerator itself, for example, the consciousness of aggressively performing the power-saving by decreasing consciously the frequency of door opening and closing has started in the user.

As described above, supporting the power-saving consciousness of the user for an aggressive power-saving action of the user himself has become a problem. In order to solve this problem, a refrigerator is proposed, in which an electricity bill or the amount of power consumption is displayed, or the frequency of door opening and closing of the storage room is displayed on a display unit of the refrigerator.

However, any of such displays are only the displays of the amount of power already consumed by the refrigerator. That is, it is not possible to know to what extent the energy-saving operation function of the refrigerator is working, thereby the energy-saving being achieved. For this reason, it is not easy for the user to take a power-saving action for increasing the rate of energy-saving operation performed by the refrigerator itself, and there is a problem in improving the degree of power saving in collaboration between the refrigerator and the user.

CITATION LIST

Patent Literature

PTL 1: Japanese Patent Unexamined Publication No. 2002-107025

SUMMARY OF THE INVENTION

The present invention provides a refrigerator and an information system, in which a rate of an energy-saving operation performed by a refrigerator itself can be known to a user, and the user tries to increase the rate of the energy-saving operation of the refrigerator itself, and thus, the energy saving can be achieved.

A refrigerator includes an energy-saving operation unit that performs a control for performing a power saving operation, a time measurement unit that measures an operation time of the energy-saving operation unit, and an energy-saving operation rate calculation unit that calculates an energy-saving operation rate based on the operation time measured by the time measurement unit. In addition, the refrigerator includes an energy-saving operation rate storage unit that stores the energy-saving operation rate calculated by the energy-saving operation rate calculation unit.

In addition, an information system includes the refrigerator described above and a mobile terminal having a display unit. The mobile terminal displays the information sent from the data transmission unit of the refrigerator on the display unit.

By the configuration described above, it is possible to notify the user of the degree of energy-saving operation. In this way, such notification can be linked to the user's aggressive power saving action, and the energy-saving operation rate of the refrigerator itself can be increased. Therefore, it is possible to promote the energy saving in the refrigerator.

DESCRIPTION OF EMBODIMENTS

Figure 1:
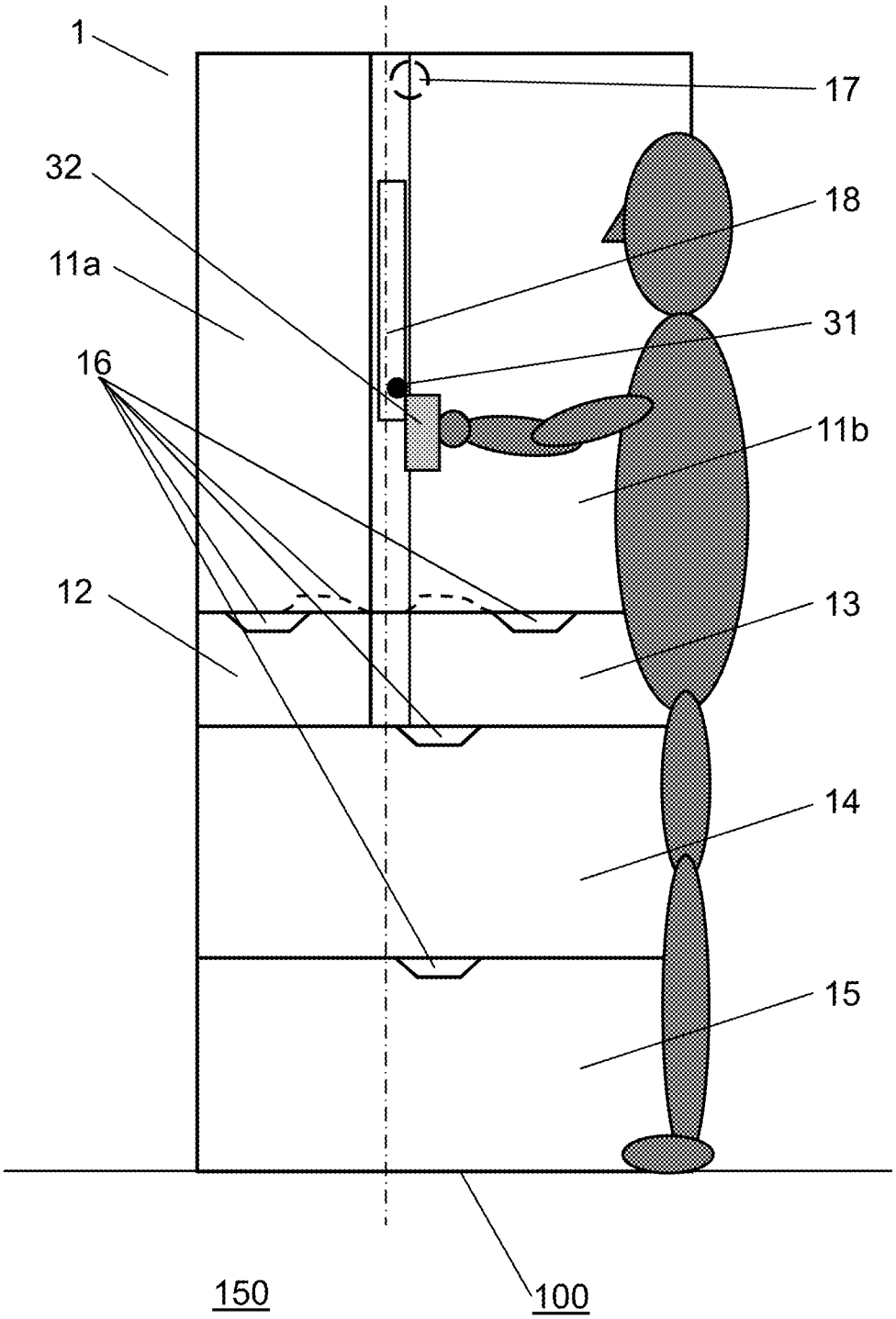
FIG. 1 is a front view illustrating a status of using a refrigerator in a first embodiment of the present invention.

Hereinafter, the embodiments of the present invention will be described in detail with reference to the drawings. The present invention will not be limited to the embodiments.

First Embodiment

A first embodiment of the present invention will be described. In the present embodiment, an example in which data transmission unit 31 that transmits data such as an energy-saving operation rate to the outside is provided in refrigerator 100, will be described. A configuration example will be described, in which, by causing mobile terminal 32 such as a mobile phone to approach data transmission unit 31, the data such as the energy-saving operation rate is displayed on display unit 49 (refer to FIG. 5) of mobile terminal 32. Information system 150 is configured to include refrigerator 100 and mobile terminal 32.

Figure 2:
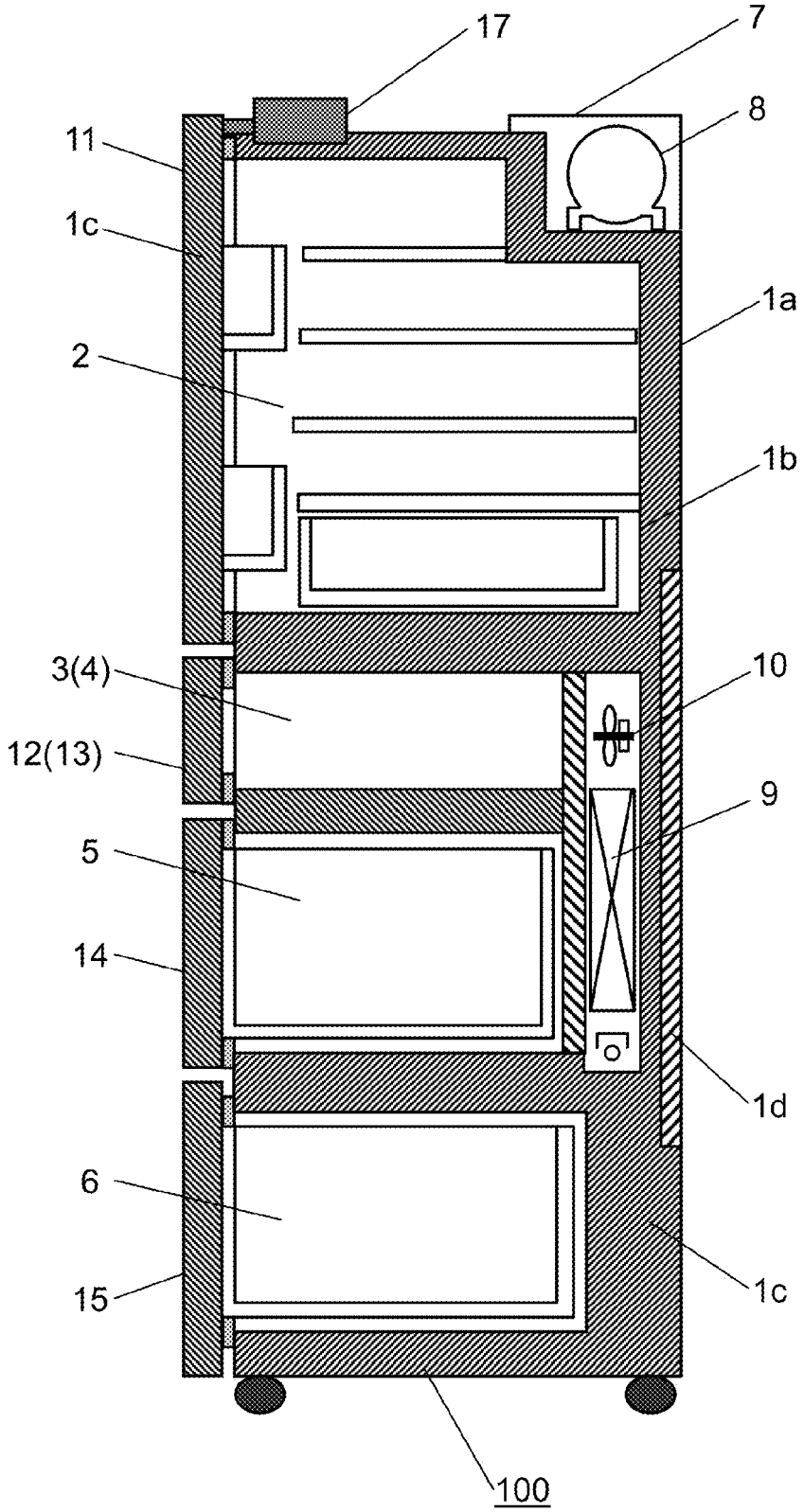
FIG. 2 is a sectional view illustrating a schematic configuration of the refrigerator in the first embodiment of the present invention.
Figure 3:
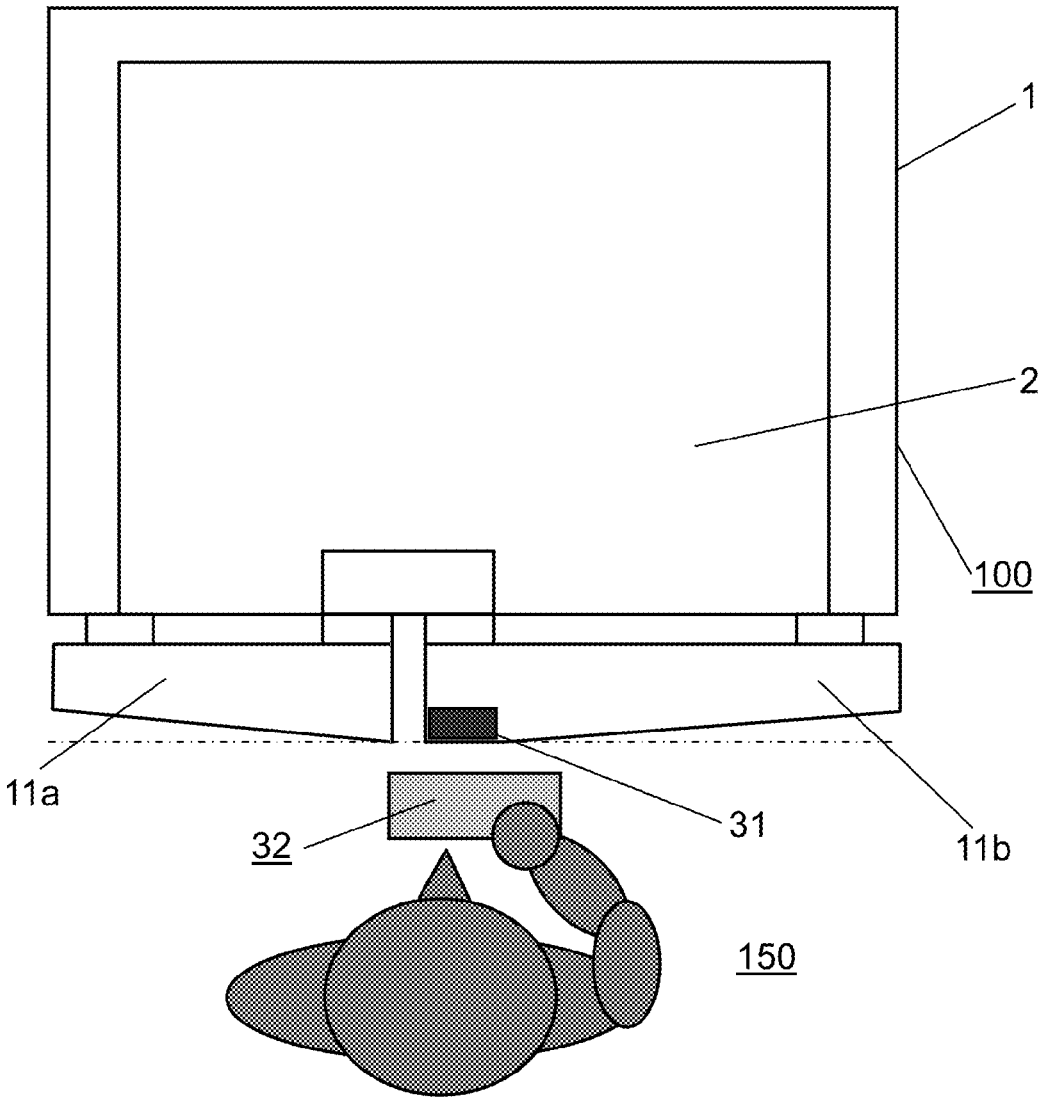
FIG. 3 is a plan view illustrating a schematic sectional configuration of the refrigerator in the first embodiment of the present invention.
Figure 4:
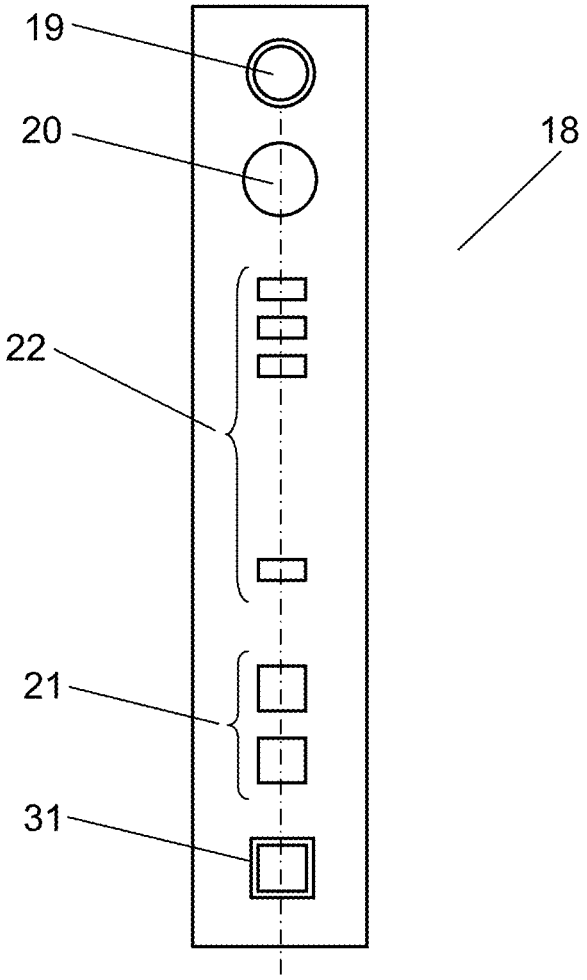
FIG. 4 is a front view illustrating a configuration of an operation unit of the refrigerator in the first embodiment of the present invention.
Figure 5:
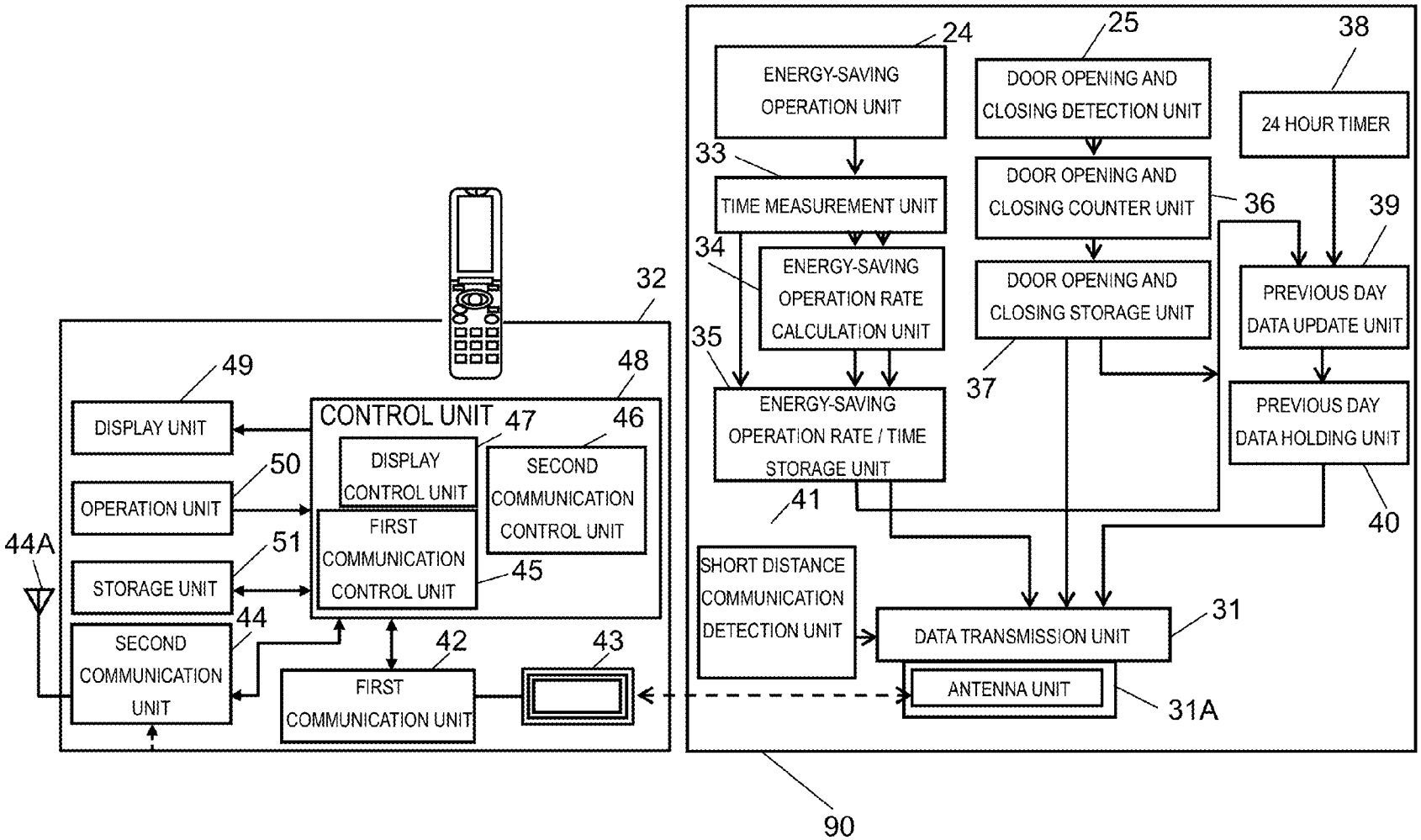
FIG. 5 is a control block diagram illustrating configurations of a refrigerator control unit of the refrigerator and a mobile terminal in the first embodiment of the present invention.
Figure 6:
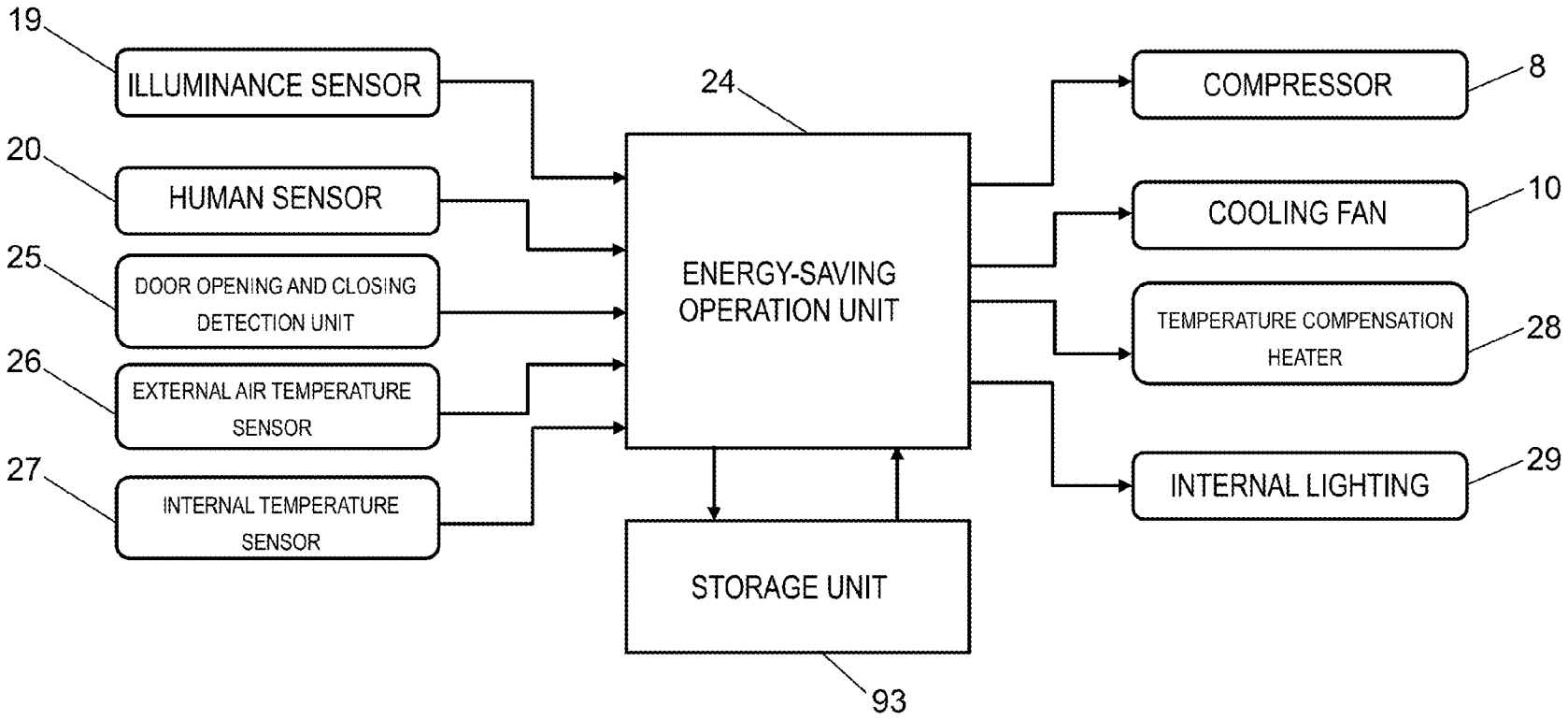
FIG. 6 is a diagram illustrating a control block for controlling an energy-saving operation of the refrigerator in the first embodiment of the present invention.
Figure 7:
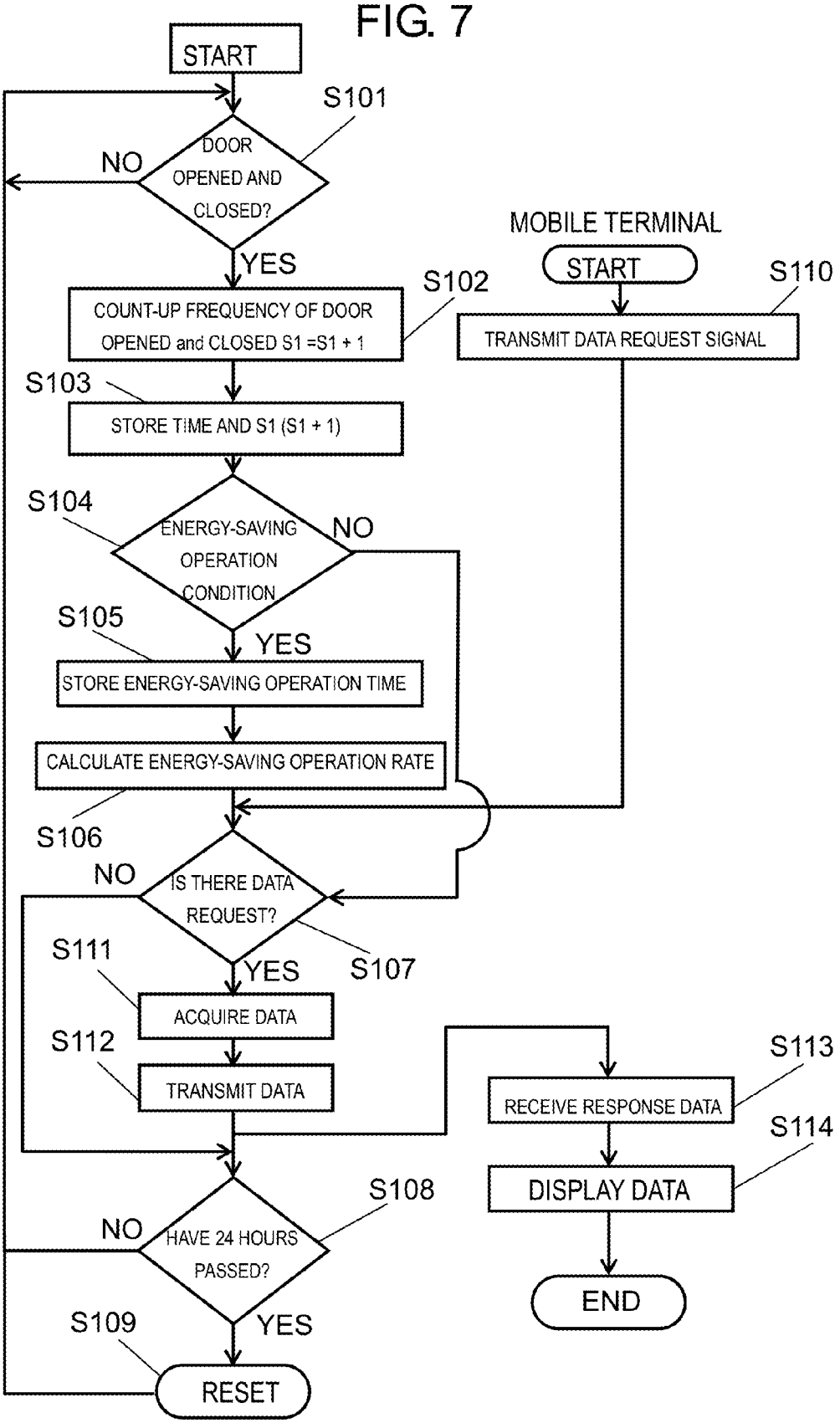
FIG. 7 is a flow chart for explaining operations in the refrigerator control unit of the refrigerator and the control unit of the mobile terminal in the first embodiment of the present invention.

FIG. 1 is a front view illustrating a status of using refrigerator 100 in a first embodiment of the present invention, FIG. 2 is a sectional view illustrating a schematic configuration of refrigerator 100, FIG. 3 is a sectional view illustrating a schematic configuration of refrigerator 100, and FIG. 4 is a front view illustrating a configuration of operation unit 18 of refrigerator 100. In addition, FIG. 5 is a control block diagram illustrating configurations of refrigerator control unit 90 of refrigerator 100 and mobile terminal 32, FIG. 6 is a diagram illustrating a control block for controlling an energy-saving operation of refrigerator 100, and FIG. 7 is a flow chart for explaining operations in refrigerator control unit 90 of refrigerator 100 and control unit 48 of mobile terminal 32.

As illustrated in FIG. 1 and FIG. 2, refrigerator 100 includes refrigerator body 1 and a plurality of storage rooms. The plurality of storage rooms are configured to include, in an order from the top, refrigerating room 2, ice making room 3, temperature switching room 4 positioned at the side of ice making room 3, freezing room 5, and vegetable room 6. This layout can be appropriately changed as necessary. A set temperature in temperature switching room 4 can be switched in a range from approximately −18° C. which is a temperature in freezing room 5 to approximately 6° C. which is a temperature in vegetable room 6.

Refrigerator body 1 is configured to include outer box 1*a* in which an iron plate is mainly used, inner box 1*b* molded from resin such as ABS, and rigid polyurethane foam 1*c* filled and foamed in a space between outer box 1*a* and inner box 1*b*. In rigid polyurethane foam 1*c* of refrigerator body 1, in order to improve heat insulation, vacuum heat insulating material 1*d* is partially embedded, if necessary. For example, in the example illustrated in FIG. 2, vacuum heat insulating material 1*d* is affixed in the space of the rear surface portion corresponding to ice making room 3, temperature switching room 4, and freezing room 5, and thus, becomes a complex with rigid polyurethane foam 1*c*.

Top surface portion of the refrigerator body 1 has a shape having a step-shaped recess toward the rear surface direction of refrigerator 100. In the step-shaped recess, machine room 7 is formed. In machine room 7, compressor 8, high-pressure side components for freezing cycle such as a dryer for water removal, and a refrigerator control unit, are accommodated. In this way, the storage capacity of vegetable room 6 at the bottom can be expanded.

On the other hand, cooler 9 configures a low pressure side of the freezing cycle. The plurality of storage rooms are cooled by cooling air generated in cooler 9 being forcibly blown by cooling fan 10 disposed at the rear side of freezing room 5.

Refrigerating room 2, ice making room 3, temperature switching room 4, freezing room 5, and vegetable room 6 are configured so as to be open and closed by doors 11 to 15 which are provided respectively corresponding thereto. Each of the plurality of doors 11 to 15 has handle portion 16. In addition, each of the plurality of doors 11 to 15, similar to refrigerator body 1, is formed by rigid polyurethane foam 1*c* being filled and foamed in the inner portion sealed by the metal of the outer surface and the resin material of the inner surface such as ABS.

Furthermore, in a part of the outer surface of door 11, a substrate storage portion formed of the resin material is disposed, and inside the substrate cover, for example, operation unit 18 having a radio frequency identification (RFID) tag is disposed. By covering the RFID tag with the resin material, it is possible to prevent the electromagnetic transmission from being influenced by the metal.

The outer surface of door 11 may be formed of a glass material instead of the metal, and by closely disposing operation unit 18 inside the glass, it is also possible to prevent the electric transmission from being influenced by the metal.

Among a plurality of doors 11 to 15, at least on door 11 of refrigerating room 2, a corresponding door opening and closing detection switch is provided, and the frequency of the door opening and closing data and accumulated door opening time data are processed in refrigerator control unit 90 (refer to FIG. 5).

In refrigerator 100 in the present embodiment, door 11 of refrigerating room 2 which is positioned at the uppermost portion of the refrigerator is a pair of double-door type doors, and is configured to include door 11*a* and 11*b* having different areas from each other disposed side by side. For example, at the end portion of right side door 11*b* (butting surface portion with left side door 11*a*), which is the most convex portion of right and left side doors 11*b* and 11*a*, operation unit 18 is provided in the vertical direction. A DC wiring for the supplying of power to operation unit 18 or for the transmission of the control signal is provided on right side door 11*b*. However, an AC wiring is not provided on right side door 11*b* but on left side door 11*a*. Right side door 11*b* includes automatic door opening and closing mechanism 17, and is configured so as to be opened by only slightly pressing the surface of door 11*b*.

Operation unit 18 is detection means for detecting a surrounding environment of the position where refrigerator 100 is installed. As illustrated in FIG. 4, operation unit 18 includes illuminance sensor 19 that detects the illuminance, human sensor 20 that detects the presence or absence of a person, electrostatic touch type setting switch 21 for performing the temperature setting of the plurality of storage rooms, and setting status display unit 22.

Refrigerator 100 in the present embodiment performs the energy-saving operation using various sensors including the above-described illuminance sensor 19 and human sensor 20.

As illustrated in FIG. 6, refrigerator 100 includes energy-saving operation unit 24, storage unit 93, illuminance sensor 19, human sensor 20, door opening and closing detection unit 25, external air temperature sensor 26, internal temperature sensor 27, compressor 8, cooling fan 10, temperature compensation heater 28, and internal lighting 29.

Energy-saving operation unit 24 performs the control of the refrigerator 100 to perform the power-saving operation.

Energy-saving operation unit 24 controls compressor 8, cooling fan 10, temperature compensation heater 28, and internal lighting 29 in an energy-saving mode based on the output from a plurality of detection means such as: illuminance sensor 19, human sensor 20, door opening and closing detection unit 25 as state detection means for detecting the using state of refrigerator 100, external air temperature sensor 26, and internal temperature sensor 27.

The illuminance level around refrigerator 100 is detected by illuminance sensor 19, the presence or absence of a person around refrigerator 100 is detected by human sensor 20, and further, a frequency of door opening and closing is detected by door opening and closing detection unit 25. When the illuminance is equal to or lower than a specified value such as at night, when a person is not detected during a predetermined time period or more due to the person having gone out or being in conversation, or when frequency of door opening and closing is low such as at the time between respective meal preparation time periods, energy-saving operation unit 24 automatically switches the operation mode to the energy-saving operation mode in which the cooling performance of refrigerator 100 is slightly lowered, and operates refrigerator 100. The degree of lowering the cooling performance is adjusted and controlled through each temperature detected by external air temperature sensor 26 and internal temperature sensor 27.

As illustrated in FIG. 4, in operation unit 18, data transmission unit 31 that outputs and transmits data such as a rate of the energy-saving operation by energy-saving operation unit 24 and the frequency of door opening and closing detected by door opening and closing detection unit 25, is provided. Data transmission unit 31 is provided in a range of a height of 900 mm or higher and 1500 mm or lower from the bottom of refrigerator body 1.

As illustrated in FIG. 1 and FIG. 3, when the user causes mobile terminal 32 such as a mobile phone, a smart phone, or a PDA to approach data transmission unit 31, data transmission unit 31 transmits the data to mobile terminal 32. The transmitted data is displayed on display unit 49 (refer to FIG. 5) of mobile terminal 32. Display unit 49 of mobile terminal 32 configures the display means for displaying the energy-saving operation rate, and the frequency of door opening and closing or the accumulated door opening time.

In this way, the user can be aware of not only the energy-saving operation rate but also the frequency of door opening and closing and the accumulated door opening time corresponding thereto. Accordingly, the user can easily take an action effective for the power saving, for example, an action to decrease the frequency of door opening and closing or the like, and thus, it is possible to certainly promote the energy saving.

Mobile terminal 32 is configured so as to be able to communicate with the internet line, and the energy-saving operation rate and the frequency of door opening and closing or the accumulated door opening time also can be displayed on a terminal of a personal computer connected to the internet line. With the configuration like this, for example, it is possible to check the energy-saving operation rate and the frequency of door opening and closing or the accumulated door opening time using a personal computer at the company. In this way, the user at the company can call the children or grandfather at home to pay attention to advance the power saving.

In FIG. 5, a functional block diagram of mobile terminal 32 and refrigerator control unit 90 of refrigerator 100 is illustrated.

Refrigerator control unit 90 includes energy-saving operation unit 24, time measurement unit 33, energy-saving operation rate calculation unit 34, and energy-saving operation rate/time storage unit 35.

Time measurement unit 33 measures the time of energy-saving operation performed by energy-saving operation unit 24.

Energy-saving operation rate calculation unit 34 calculates the energy-saving operation rate based on the time measured by time measurement unit 33. Specifically, energy-saving operation rate calculation unit 34 calculates the energy-saving operation rate per day by dividing the energy-saving operation time measured by time measurement unit 33 by 24 hours. In this way, since the user can be aware of the energy-saving operation rate in the unit of a day, a frequent power saving efforts are expected to be performed, and thus, it is possible to promote the energy saving.

Energy-saving operation rate/time storage unit 35 stores the time output from time measurement unit 33 and the energy-saving operation rate output from energy-saving operation rate calculation unit 34. Energy-saving operation rate/time storage unit 35 has a function of an energy-saving operation rate storage unit for storing the rate calculated by energy-saving operation rate calculation unit 34.

In addition, refrigerator control unit 90 includes door opening and closing detection unit 25, door opening and closing counter unit 36, door opening and closing storage unit 37, 24 hour timer 38, previous day data update unit 39, and previous day data holding unit 40.

Door opening and closing counter unit 36 counts the frequency of door opening and closing detected by door opening and closing detection unit 25.

Door opening and closing storage unit 37 stores the frequency of door opening and closing counted by door opening and closing counter unit 36.

Previous day data update unit 39 updates the frequency of door opening and closing stored in door opening and closing storage unit 37, and the energy-saving operation rate and energy-saving operation time stored in energy-saving operation rate/time storage unit 35, for every 24 hours, based on the output from 24 hour timer 38.

Previous day data holding unit 40 stores and holds the data of previous day which is updated by previous day data update unit 39. Previous day data holding unit 40 stores at least one data item of previous day among the energy-saving operation rate, and the frequency of door opening and closing or the accumulated door opening time.

Furthermore, refrigerator control unit 90 includes data transmission unit 31. Data transmission unit 31 functions as an output unit for outputting the data of the energy-saving operation rate and the frequency of door opening and closing or the like, and is formed of an IC chip which is integrated with antenna unit 31A. Data transmission unit 31 is configured so as to transmit the data of the energy-saving operation rate and the frequency of door opening and closing or the like output from energy-saving operation rate/time storage unit 35 and door opening and closing storage unit 37, together with each data item of previous day from previous day data holding unit 40.

According to the above-described configuration, since the data is transmitted in the collective form in a specific time period rather than a constant communication, the amount of data communication can be reduced, and the time for communication can be reduced, and thus, it is possible to reduce a risk that a communication error occurs. In this way, the improvement in reliability can be achieved and the user's feeling of operation can be improved.

In addition, refrigerator control unit 90 includes short distance communication detection unit 41. When mobile terminal 32 such as a mobile phone, a smart phone, or a PDA approaches short distance communication detection unit 41 and requests the data, short distance communication detection unit 41 detects the request. When the data request is detected, short distance communication detection unit 41 is configured to supply the power to data transmission unit 31 to operate.

Therefore, when mobile terminal 32 approaches and requests the data, data transmission unit 31 is brought into an operation state by short distance communication detection unit 41, and the data of the recent frequency of door opening and closing stored in door opening and closing storage unit 37, and the data of the energy-saving operation rate or the like stored in energy-saving operation rate/time storage unit 35, are transmitted to the outside from antenna unit 31A.

Next, the configuration of mobile terminal 32 will be described. In the present embodiment, a typical mobile phone is used as mobile terminal 32.

Mobile terminal 32 includes first communication unit 42 that performs a proximity communication and antenna 43 thereof, second communication unit 44 for a voice call and the internet communication and antenna 44A thereof, and control unit 48 that includes first communication control unit 45 and second communication control unit 46 that control above-described communication units respectively and display control unit 47.

Mobile terminal 32 further includes display unit 49 such as a liquid crystal display, operation unit 50 such as a touch switch, storage unit 51, and the like.

By the operation of operation unit 50, when mobile terminal 32 is switched to the proximity communication by first communication control unit 45 from the communication by second communication control unit 46, mobile terminal 32 transmits the data request signal to the opposite party and comes into the state of receiving the data from the opposite party. Then, display control unit 47 switches the display of display unit 49, and then displays the data received by first communication unit 42 on display unit 49.

That is, by causing antenna 43 of first communication unit 42 to approach data transmission unit 31 of refrigerator 100, mobile terminal 32 can receive the data of the energy-saving operation rate and the frequency of the door opening and closing or the like from data transmission unit 31, and can display the data on display unit 49.

According to this configuration, by causing mobile terminal 32 such as a mobile phone to approach data transmission unit 31, the user can cause the energy-saving operation rate or the like to be displayed on display unit 49 of mobile terminal 32, and can be aware of the energy-saving operation rate or the like. In addition, in refrigerator 100 side, the display device can be removed to eliminate the use of the power for displaying the frequency of door opening and closing or the like, and it is possible to further reduce the power consumption of refrigerator 100.

There are various means as the proximity communication means between mobile terminal 32 and data transmission unit 31 other than the means using the RFID, and any of the infrared communication, a wireless LAN, or Bluetooth® may be used. Considering the situation of a commercial mobile phone or a smart phone being used, it is preferable to use the proximity communication means in which the mobile phones and the smart phones can perform the exchanging of the data such as the telephone numbers. In the present embodiment, the short distance communication method like this is adopted.

In information system 150 with the configuration described above, the operation thereof will be described using FIG. 7.

First, it is assumed that the user opens the door of refrigerator 100, for example, right side door 11*b* of refrigerating room 2 in order to take the stored food in or out. Then, door opening and closing detection unit 25 detects the door opening and closing, and outputs signal S1 to door opening and closing counter unit 36 (S101).

Door opening and closing counter unit 36, when receiving signal S1 (Yes in S101), adds the increment "+1" to the counted number which is the frequency of the door opening and closing, and outputs the result to door opening and closing storage unit 37 (S102). Door opening and closing storage unit 37 stores the frequency of the door opening and closing, that is, the frequency S1 where "+1" is added as described above (S103).

On the other hand, the illuminance level around refrigerator 100 is detected by illuminance sensor 19, the presence or absence of a person around refrigerator 100 is detected by human sensor 20, and further, a frequency of door opening and closing is detected by door opening and closing detection unit 25, and then, energy-saving operation unit 24 checks whether or not the detection results meets the energy-saving operation conditions (S104).

When the illuminance is equal to or lower than a specified value such as at night, when a person is not detected during a predetermined time period or more due to the person having gone out or being in conversation, or when frequency of door opening and closing is low such as at the time between respective meal preparation time periods, then, the above situations are determined to meet the energy-saving operation conditions (Yes in S104). Then, refrigerator 100 automatically switches the operation mode from the ordinary operation mode to the energy-saving operation mode in which the cooling performance of refrigerator 100 is slightly lowered, to operate. In a case where the detection results are determined not to meet the energy-saving operation conditions (No in S104), the process proceeds to S107.

In a case where the detection result meets the energy-saving operation conditions in STEP S104, the time of energy-saving operation performed by energy-saving operation unit 24 is stored in energy-saving operation rate/time storage unit 35 (S105), and the energy-saving operation rate is calculated by energy-saving operation rate calculation unit 34 (S106).

In STEP S107, short distance communication detection unit 41 checks whether or not there is data request from mobile terminal 32. In a case where there is no data request (No in S107), 24 hour timer 38 checks whether one day (24 hours) has passed or not (S108). In a case where one day has not passed (No in S108), the process returns to S101.

On the other hand, in STEP S108, in a case where one day has passed (Yes in S108), the frequency of door opening and closing, the energy-saving operation time, and the energy-saving operation rate that have been stored up to that time are reset (S109), and the process returns to S101.

If the user causes antenna 43 portion of mobile terminal 32 to approach data transmission unit 31 on door 11*b* of refrigerator 100, and mobile terminal 32 transmits the data request signal (S110), short distance communication detection unit 41 detects the signal, and data transmission unit 31 starts to operate (Yes in S107).

Specifically, data transmission unit 31 acquires the frequency of door opening and closing stored in door opening and closing storage unit 37, and the energy-saving operation time and the energy-saving operation rate stored in energy-saving operation rate/time storage unit 35 (S111).

Data transmission unit 31 transmits the acquired data to mobile terminal 32 (S112). Mobile terminal 32 receives the transmitted data (S113) and displays the data on display unit 49 (S114).

At this time, the user can be aware of the energy-saving operation rate and the energy-saving operation time (hereafter, referred to as energy-saving operation rate/time) and the frequency of door opening and closing by viewing display unit 49. In this way, it is easy for the user to take a power-saving action, for example, to be careful to reduce the frequency of door opening and closing or to lower the illuminance in the kitchen when not in use so as to increase the energy-saving operation. In order to lower the illuminance in the kitchen, the user can turn off the lights or close the curtains to make the kitchen dark. In this way, by the user taking a power-saving action, the energy-saving operation conditions are met, and thus, energy-saving operation unit 24 can start the energy-saving operation.

In addition, the user can compare the energy-saving operation rate/time and the frequency of door opening and closing with the data of the previous day. That is, the energy-saving operation rate/time and the frequency of door opening and closing of the day and the previous day can be displayed on display unit 49. Accordingly, the user can accurately ascertain the energy-saving operation rate/time and the frequency of door opening and closing compared with the previous day, and thus, it is possible to take an effective power-saving action. In this way, it is possible to promote the energy saving.

In addition, since the frequency of door opening and closing data or the like is displayed on mobile terminal 32 side, it is possible to remove the display device for displaying the energy-saving operation rate/time and the frequency of door opening and closing at refrigerator 100 side. Furthermore, even if the display device is provided, when the energy-saving operation rate/time and the frequency of door opening and closing reach a predetermined value, since the display device may only perform the display sufficient for notifying that fact, it is possible to reduce the power consumption of refrigerator 100 itself.

In the present embodiment, the display device on refrigerator 100 side for notifying the energy-saving operation rate/time and the frequency of door opening and closing is removed, and the display power for notifying the user of the frequency of door opening and closing is not needed. In this way, power can further be saved, and it is possible to promote the energy saving in refrigerator 100.

Furthermore, in the present embodiment, short distance communication detection unit 41 is provided at refrigerator 100 side, and only in a case where short distance communication detection unit 41 detects that the data is requested, the power is supplied to data transmission unit 31 and the data is transmitted. In this way, in a case where there is no data request, data transmission unit 31 does not consume the power, and it is possible to further achieve the energy saving by that much.

Furthermore, in the present embodiment, the user can check the frequency of the door opening and closing or the like, for example, by displaying the frequency of the door opening and closing or the like on a personal computer at a company using the internet line via second communication unit 44 of mobile terminal 32. In this way, the user can call the children or grandfather at home to pay attention for reducing the frequency of door opening and closing of refrigerator 100.

In addition, in refrigerator 100 in the present embodiment, data transmission unit 31 is provided on the most convex portion of the door surface (refer to FIG. 3). In this way, mobile terminal 32 can approach or be in contact with data transmission unit 31, and it is possible to secure the reliable communication performance. Furthermore, it is possible to maintain a good external appearance of the door for a long time without damaging the external appearance of the door in the peripheral edge of data transmission unit 31 by mobile terminal 32.

In addition, data transmission unit 31 is provided on door 11 of the storage room which is on the highest position of refrigerator 100, that is, provided on door 11 of uppermost storage room among a plurality of storage rooms. In this way, there is no such a failure as in the case of providing data transmission unit 31 on the doors located at the lower part, that is, a failure that the cooling air leaked and fell down when the door positioned upper than the door on which data transmission unit 31 is provided is opened touches data transmission unit 31, and the condensation occurs on the surface of data transmission unit 31, and thus, the communication state deteriorates and the component reliability decreases.

In addition, data transmission unit 31 is provided on door 11 which corresponds to refrigerating room 2 among a plurality of storage rooms. Since the temperature in refrigerating room 2 is higher than that in ice making room 3 or freezing room 5, it is possible to suppress the influence of the cooling air in the room on data transmission unit 31 to be small. That is, since the difference in temperature between the surface and the inner portion of data transmission unit 31 is suppressed to be small, and the occurrence of the condensation can be suppressed, it is possible to reduce the failure such as the deterioration of the communication state and the decrease of the component reliability.

In addition, data transmission unit 31 is incorporated into operation unit 18 provided at the end portion of right side door 11*b*. In this way, even if the affixing of the sticker to door 11*b* performed by the user on a daily basis is performed at the center portion of the door, the risk of occurring the communication failure caused by the sticker which covers the surface of data transmission unit 31 can be reduced, and it is possible to reliably secure the communication performance.

In addition, data transmission unit 31 is provided on right side door 11*b* having the larger size among the double-door type doors 11 of the storage room. In this way, it is possible to reduce the occurrence of the failure in data transmission unit 31 due to the cooling air in the refrigerating room. There are many right-handed users and the frequency of the opening and closing right side door 11*b* by the right-handed user is high. In a case where right side door 11*b* is opened and the cooling air in the refrigerating room leaks out, there is a high possibility that the cooling air diffuses in the surface of left side door 11*a* at the opposite side of right side door 11*b*, and thus, the possibility that the cooling air goes around into the surface side of right side door 11*b* (data transmission unit 31 installed side) which is the rear side seen from the leaked cooling air, is very low. Therefore, there is almost no possibility that the cooling air touches data transmission unit 31 provided on right side door 11*b*, and it is possible to suppress the failure such as the deterioration of the communication state and the decrease of the component reliability due to the condensation occurring on the surface of data transmission unit 31. When the door having a larger size is opened, the more cooling air leaks out. Therefore, it is advantageous to provide data transmission unit 31 on right side door.

In addition, only the DC wiring is provided on the door on which data transmission unit 31 is provided and the AC wiring is not provided. In this way, the transmission of data transmission unit 31 is not interfered by the noise occurred from the AC wiring, and thus, it is possible to secure the accurate and reliable communication performance.

Furthermore, on right side door 11*b* of the storage room, on which data transmission unit 31 is provided, corresponding automatic door opening and closing mechanism 17 is provided. Moreover, data transmission unit 31 is disposed at the position separated from handle portions 16 respectively provided on doors 11 to 15 and the position higher than handle portion 16. In this way, even if the user touches door 11*b* with the wet hand, the amount of water drops on the wet hand which attaches to door 11*b* is small, and since handle portion 16 is separated from data transmission unit 31, data transmission unit 31 does not get wet by the water drops, and thus, it is possible to reduce the failure such as the deterioration of the communication state and the decrease of the component reliability.

Second Embodiment

Next, a second embodiment of the present invention will be described.

Figure 8A:
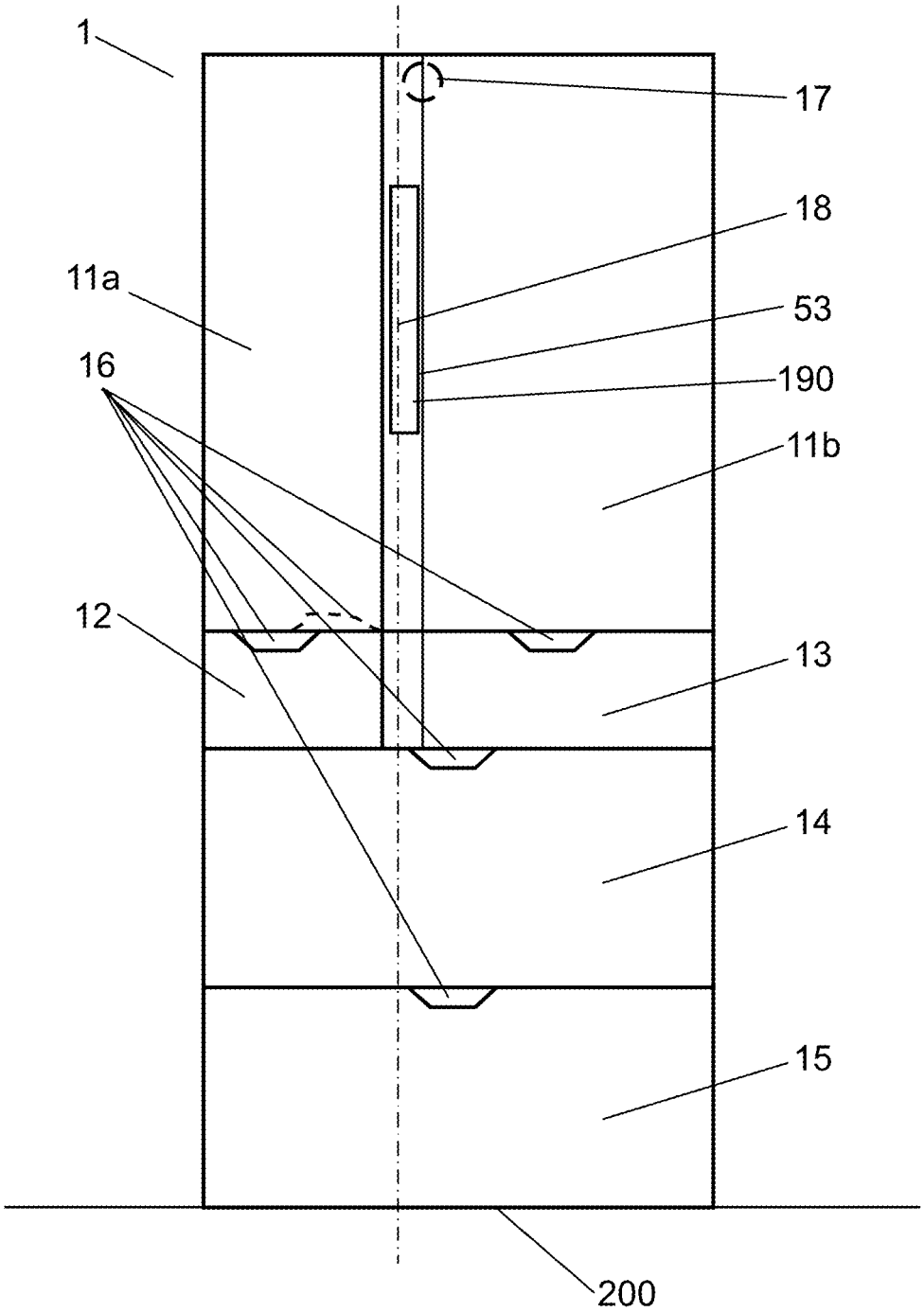
FIG. 8A is a front view illustrating a configuration of a refrigerator in a second embodiment of the present invention.

FIG. 8A is a front view illustrating a configuration of refrigerator 200 in a second embodiment of the present invention. In addition, FIG. 8B is a functional block diagram of refrigerator control unit 190 of refrigerator 200.

In the present embodiment, the components common to those of refrigerator 100 in the first embodiment will be referenced by the same reference numbers, and the descriptions thereof will be omitted.

As illustrated in FIG. 8A, in refrigerator 200, display unit 53 for displaying the energy-saving operation rate/time and the frequency of door opening and closing is provided on right side door 11*b* of refrigerator body 1.

Figure 8B:
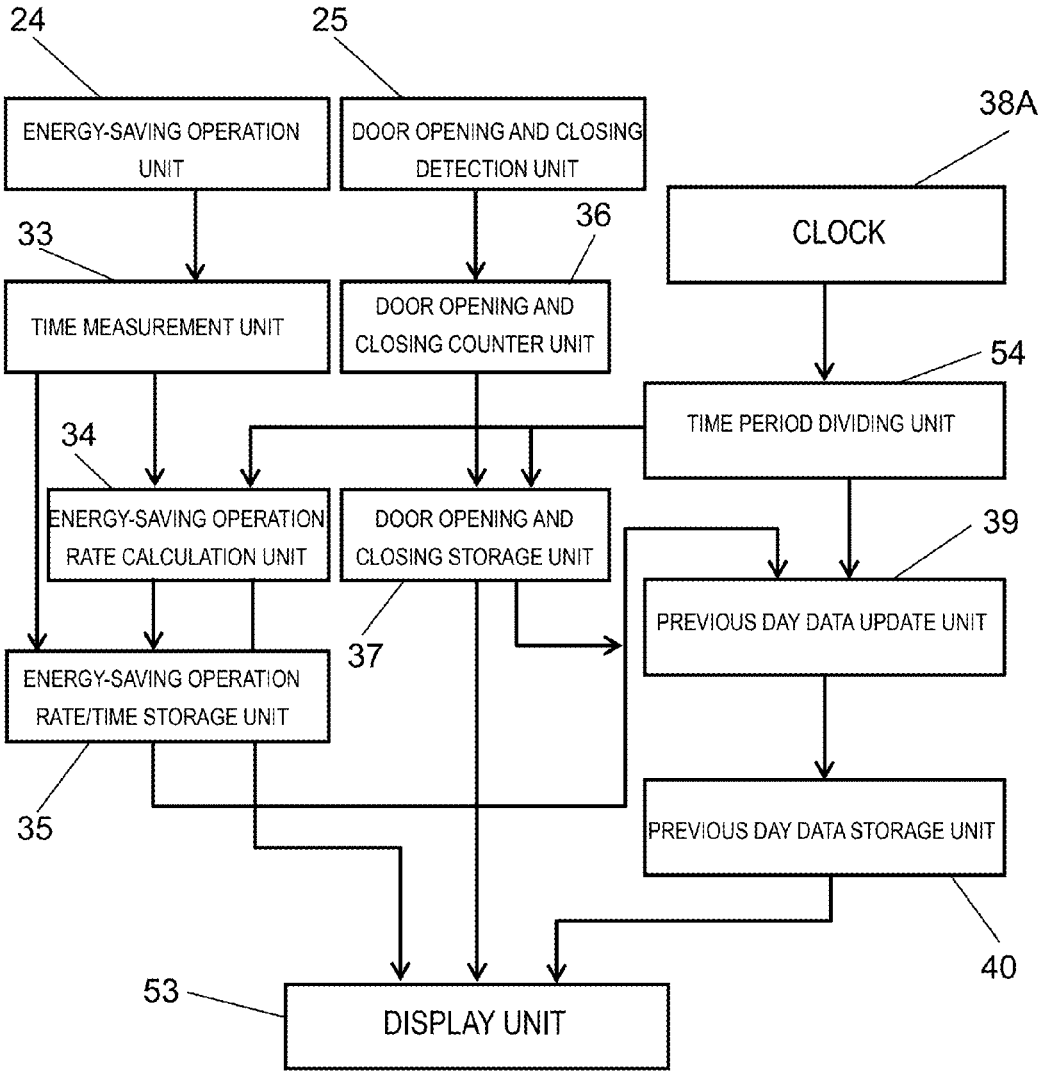
FIG. 8B is a functional block diagram of a refrigerator control unit of the refrigerator in the second embodiment of the present invention.

As illustrated in FIG. 8B, in refrigerator 200 in the present embodiment, refrigerator control unit 190 has a different configuration compared to refrigerator 100 in the first embodiment.

Specifically, 24 hour timer 38 is replaced by clock 38A. In addition, refrigerator control unit 190 includes time period dividing unit 54 that divides the time into a plurality of time periods based on the time output from clock 38A.

According to the configuration, the energy-saving operation rate/time and the frequency of door opening and closing output from energy-saving operation rate calculation unit 34 and door opening and closing storage unit 37 can be calculated, stored, and displayed by being divided into, four time periods such as breakfast (06:00 to 12:00), lunch (12:00 to 18:00), dinner (18:00 to 24:00), and sleeping (24:00 to 06:00).

By using such refrigerator 200, as similar to refrigerator 100 in the first embodiment, the user can be aware of the energy-saving operation rate/time and the frequency of door opening and closing by comparing the data of previous day. Accordingly, the user is careful so as to increase the energy-saving operation, for example, to reduce the frequency of door opening and closing from now on. Therefore, energy-saving operation rate by energy-saving operation unit 24 can be increased, and it is possible to promote the energy saving.

Furthermore, the data during each time period, for example, in a case of breakfast time period, the energy-saving operation rate/time and the frequency of door opening and closing during the breakfast time period are displayed on display unit 53. Therefore, the user can accurately ascertain the energy-saving operation rate/time and the frequency of door opening and closing during the breakfast time period.

Accordingly, it is advantageous because the user can accurately know whether the energy-saving operation rate/time and the frequency of door opening and closing during a specific time period, for example, the breakfast time period, is small or large.

Clock 38A and time period dividing unit 54 may be mounted on refrigerator 100 in the first embodiment and the data can be output for each time period, or conversely, 24 hour timer 38 may be mounted on refrigerator 200 and the data can be displayed for each day.

Display unit 53 of refrigerator 200 described in the second embodiment may be mounted on refrigerator 100 described in the first embodiment, and the data transmission and display can be performed.

As described above, if refrigerator 100 and refrigerator 200 described in the first and second embodiments respectively are used, it is possible to make the user know the energy-saving operation rate/time. Accordingly, for example, the energy-saving operation rates of refrigerator 100 or 200 itself is increased in connection to the aggressive power saving action of the user such as reducing the frequency of door opening and closing, and thus, it is possible to promote the energy saving of refrigerator 100 or 200.

In this way, the user can be aware of the rate of the energy-saving operation performed by refrigerators 100 and 200 itself. As a result, the user can be aware of a remained degree of energy-saving operation with respect to the maximum 100%. In this way, the user can increase the energy-saving operation rate of refrigerator 100 or 200 itself by performing an aggressive power saving action such as reducing the frequency of door opening and closing or lowering the illuminance of room where refrigerator 100 or 200 is installed, and thus, it is possible to improve the energy saving.

The configurations described in the first embodiment and the second embodiment are some aspects for realizing the present invention, and various modifications can be made within the objective scope of the present invention.

For example, in the present embodiment described above, energy-saving operation rate/time and the frequency of door opening and closing can be known. However, only the energy-saving operation rate or the energy-saving operation time may be known (or displayed). In addition, the door opening and closing time (at least the opening time) may be known instead of the frequency of door opening and closing.

In addition, in the description, energy-saving operation rate calculation unit 34 and energy-saving operation rate/time storage unit 35 are the separated configuration components each other. However, the configuration in the present invention is not limited thereto. For example, a storage function may be included in energy-saving operation rate calculation unit 34, that is, the configuration in which energy-saving operation rate calculation unit 34 also serves as energy-saving operation rate/time storage unit 35, may be used.

As described above, in a case where the door opening and closing time is known (displayed) by refrigerator 100 or 200 instead of the frequency of door opening and closing, door opening and closing counter unit 36 has a function of counting the time of door opening and closing, and door opening and closing storage unit 37 has a function of storing such information.

In addition, in the configuration in which refrigerator 100 includes data transmission unit 31, data transmission unit 31 is described as having only a transmission function. However, a data transmission and receiving unit that also has a receiving function can be used. For example, applications can be considered, in which the frequency of door opening and closing data and the accumulated door opening time data from refrigerator control unit 90, which enables the internal temperature to be set by transmitting the set temperature data to data transmission unit 31 from mobile terminal 32 side, are received by the transmission and receiving unit through the short distance wireless communication, not through the wiring.

In a case where the transmission and receiving unit having a function of transmission and receiving as data transmission unit 31 is used, in corresponding to the transmission and receiving unit provided on door 11, a transmission and receiving unit can also be provided on refrigerator body 1 side. In the configuration, when door 11 is opened, the transmission and receiving unit on refrigerator body 1 side can detect the opening, that is, the transmission and receiving unit on door 11 serves as door opening and closing detection unit 25 also. In this way, it is possible to simplify the configuration.

It is preferable that door opening and closing detection unit 25 is provided corresponding to all the doors 11 to 15, however, for example, door opening and closing detection unit 25 may be provided on one or a part of doors of which the frequency of opening and closing is high.

Third Embodiment

Next, a third embodiment of the present invention will be described. In the present embodiment, an example of providing data transmission unit 121 on refrigerator 1100, which transmits the frequency of door opening and closing data to the outside, will be described. A configuration in which, by causing mobile terminal 122 such as a mobile phone to approach data transmission unit 121, the frequency of door opening and closing data or the like is displayed on display unit 139 (refer to FIG. 13) of mobile terminal 122, will be described. Information system 1150 is configured to include refrigerator 1100 and mobile terminal 122.

Figure 9:
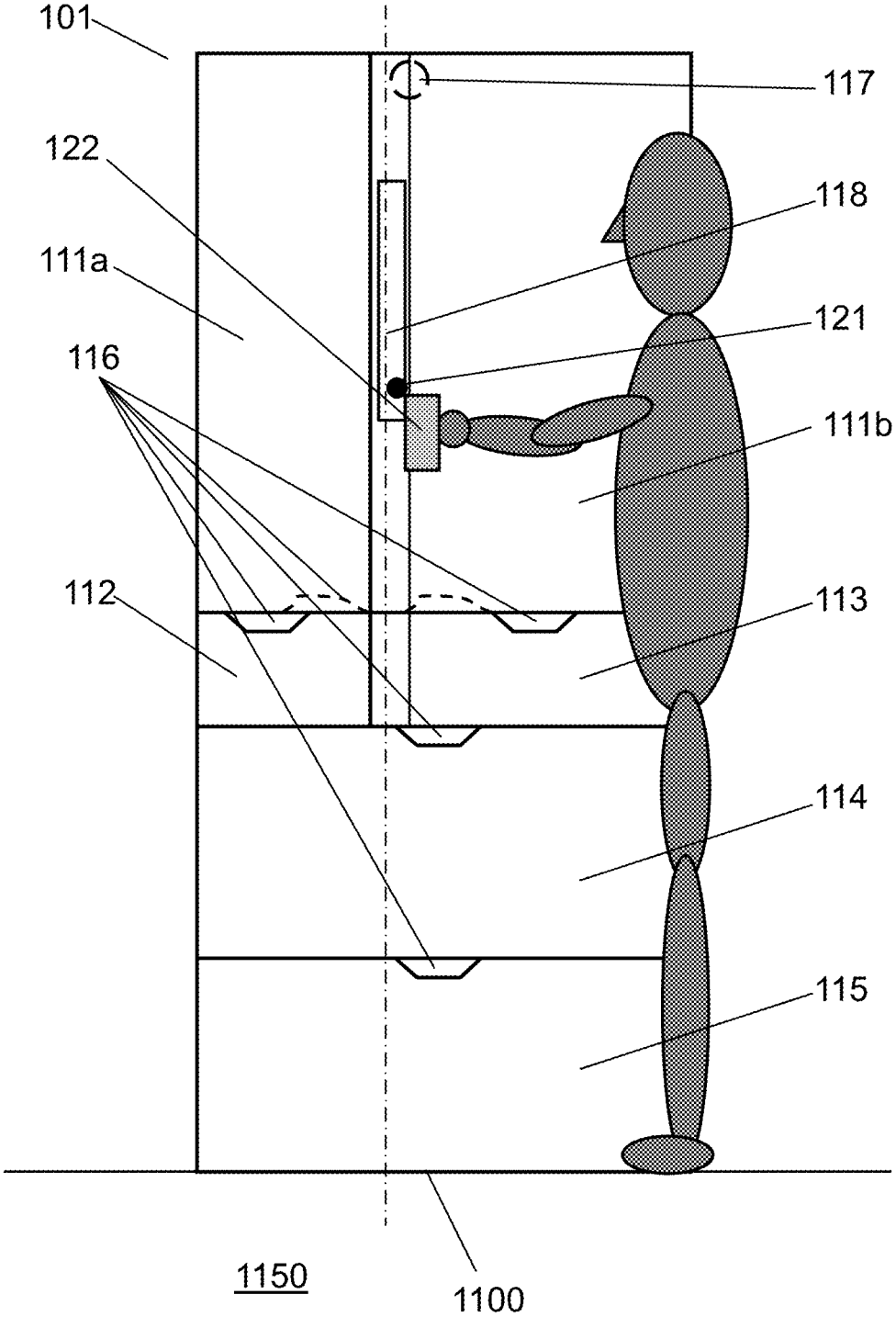
FIG. 9 is a front view illustrating a status of using a refrigerator in a third embodiment of the present invention.
Figure 10:
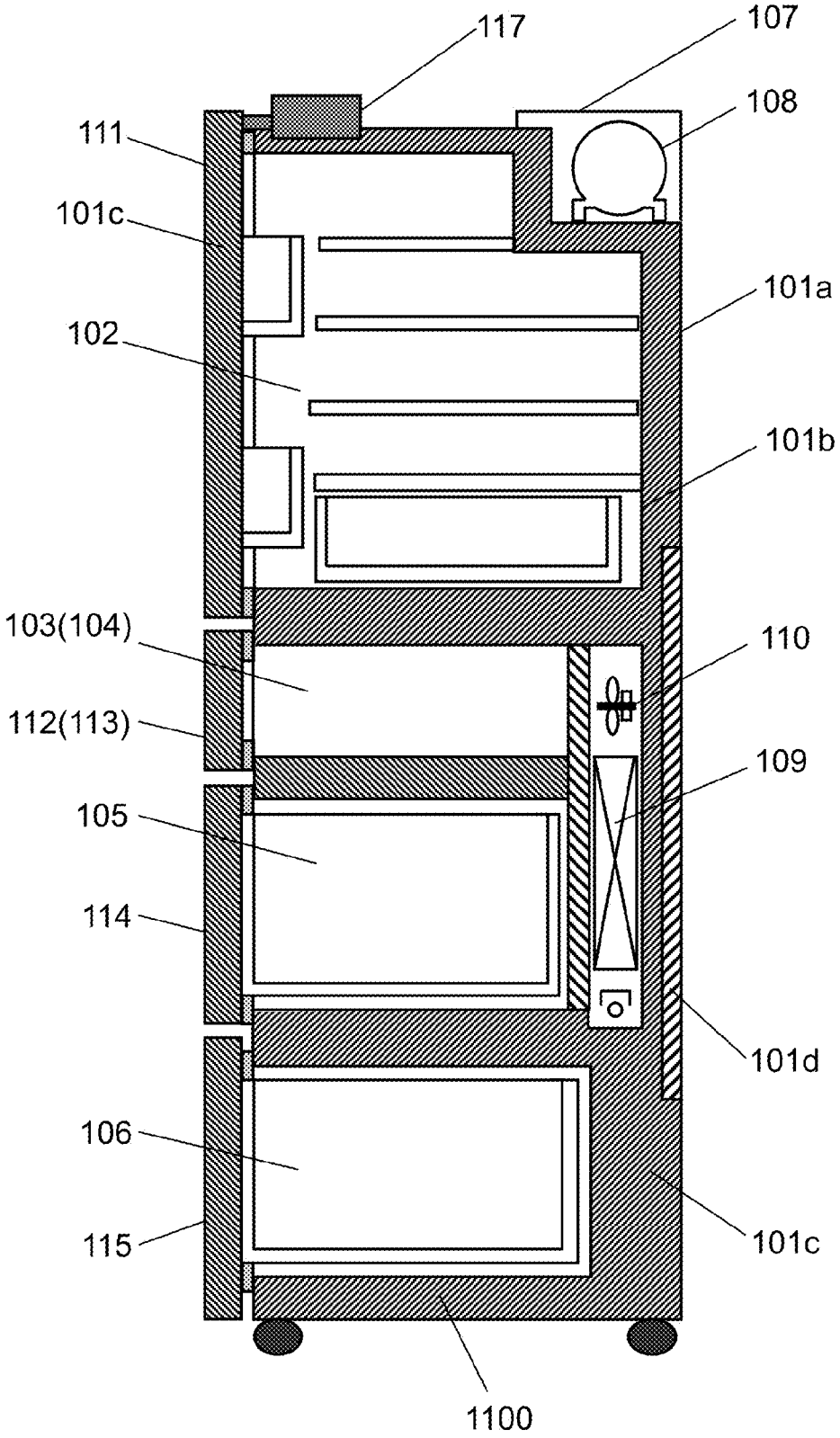
FIG. 10 is a sectional view illustrating a schematic configuration of the refrigerator in the third embodiment of the present invention.
Figure 11:
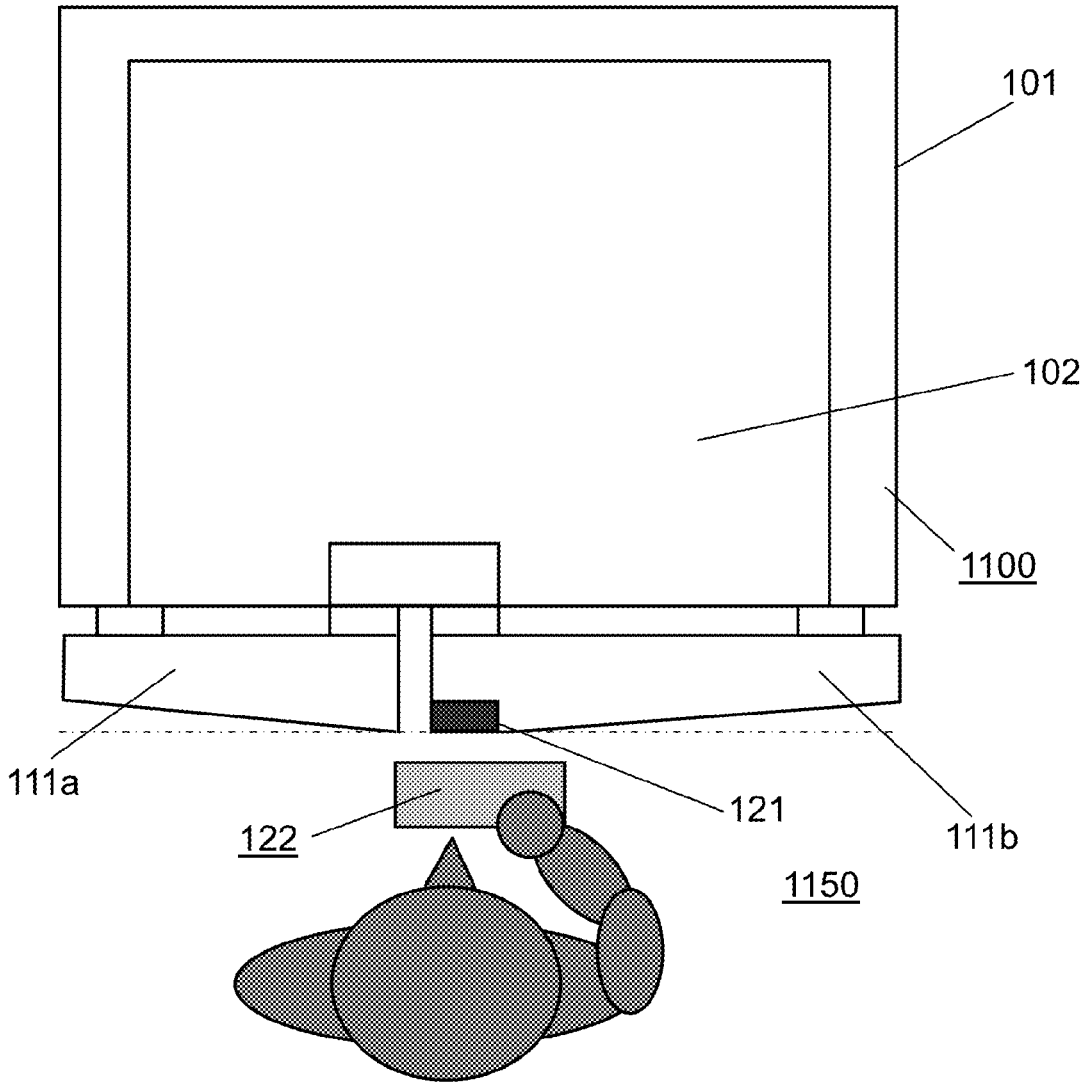
FIG. 11 is a plan view illustrating a schematic sectional configuration of the refrigerator in the third embodiment of the present invention.
Figure 12:
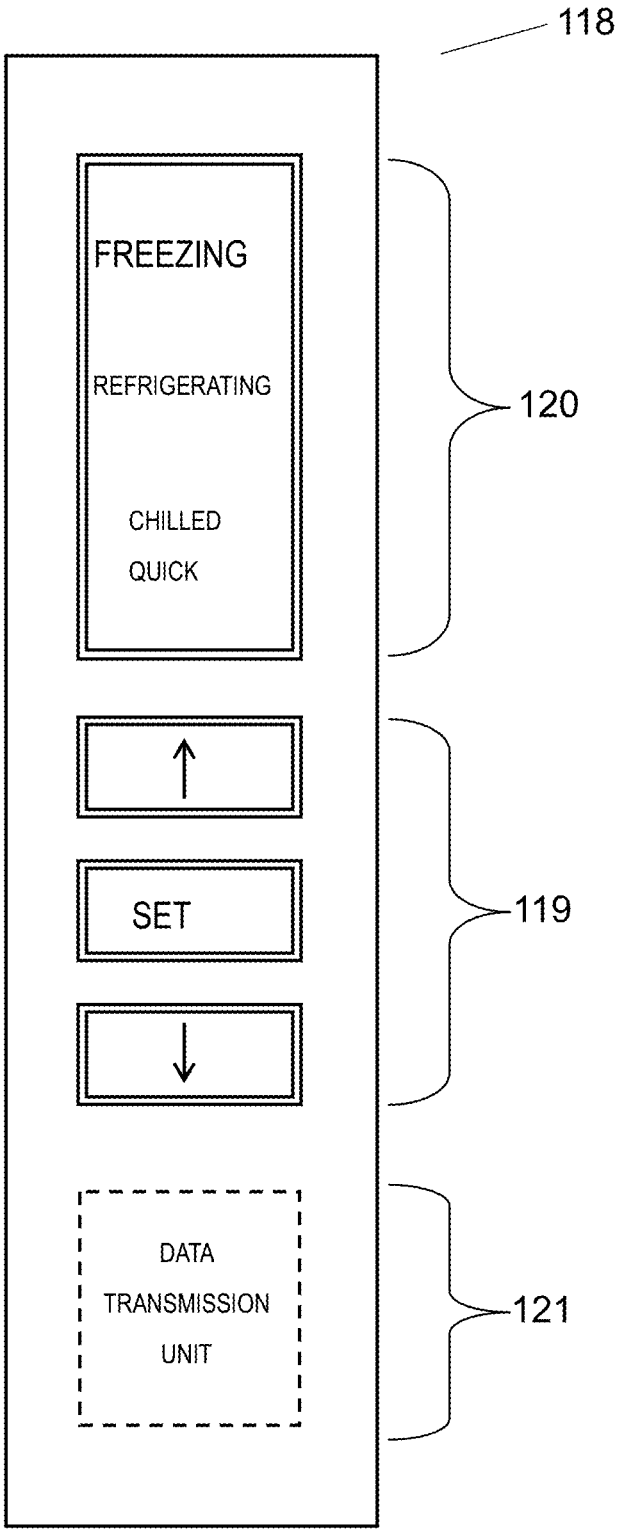
FIG. 12 is a front view illustrating a configuration of an operation unit of the refrigerator in the third embodiment of the present invention.

FIG. 9 is a front view illustrating a status of using refrigerator 1100 in the third embodiment of the present invention, FIG. 10 is a sectional view illustrating a schematic configuration of refrigerator 1100, FIG. 11 is a plan view illustrating a schematic sectional configuration of refrigerator 1100, and FIG. 12 is a front view illustrating configuration of an operation unit 118 of refrigerator 1100.

Figure 13:
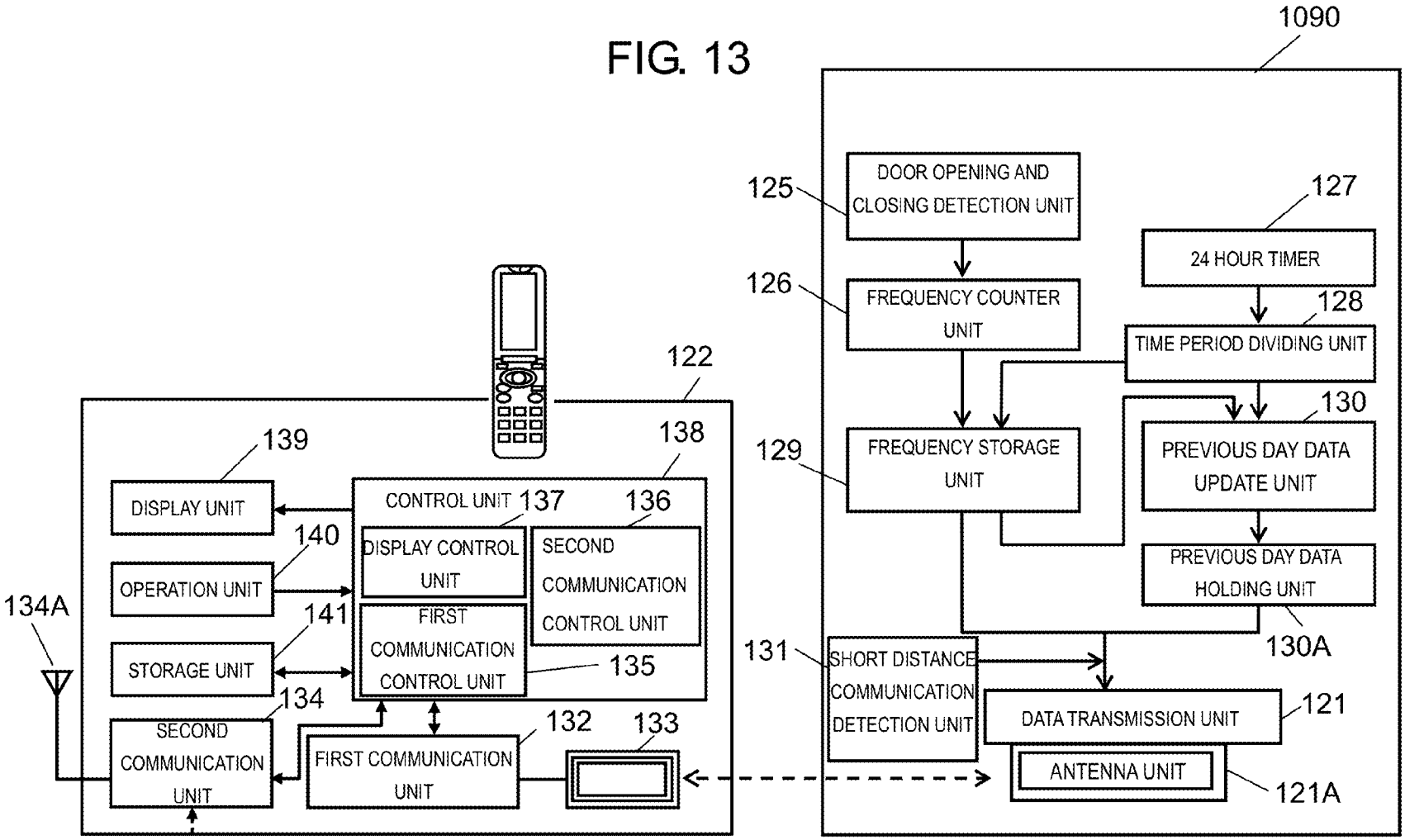
FIG. 13 is a control block diagram illustrating configurations of a refrigerator control unit of the refrigerator and a mobile terminal in the third embodiment of the present invention.
Figure 14:
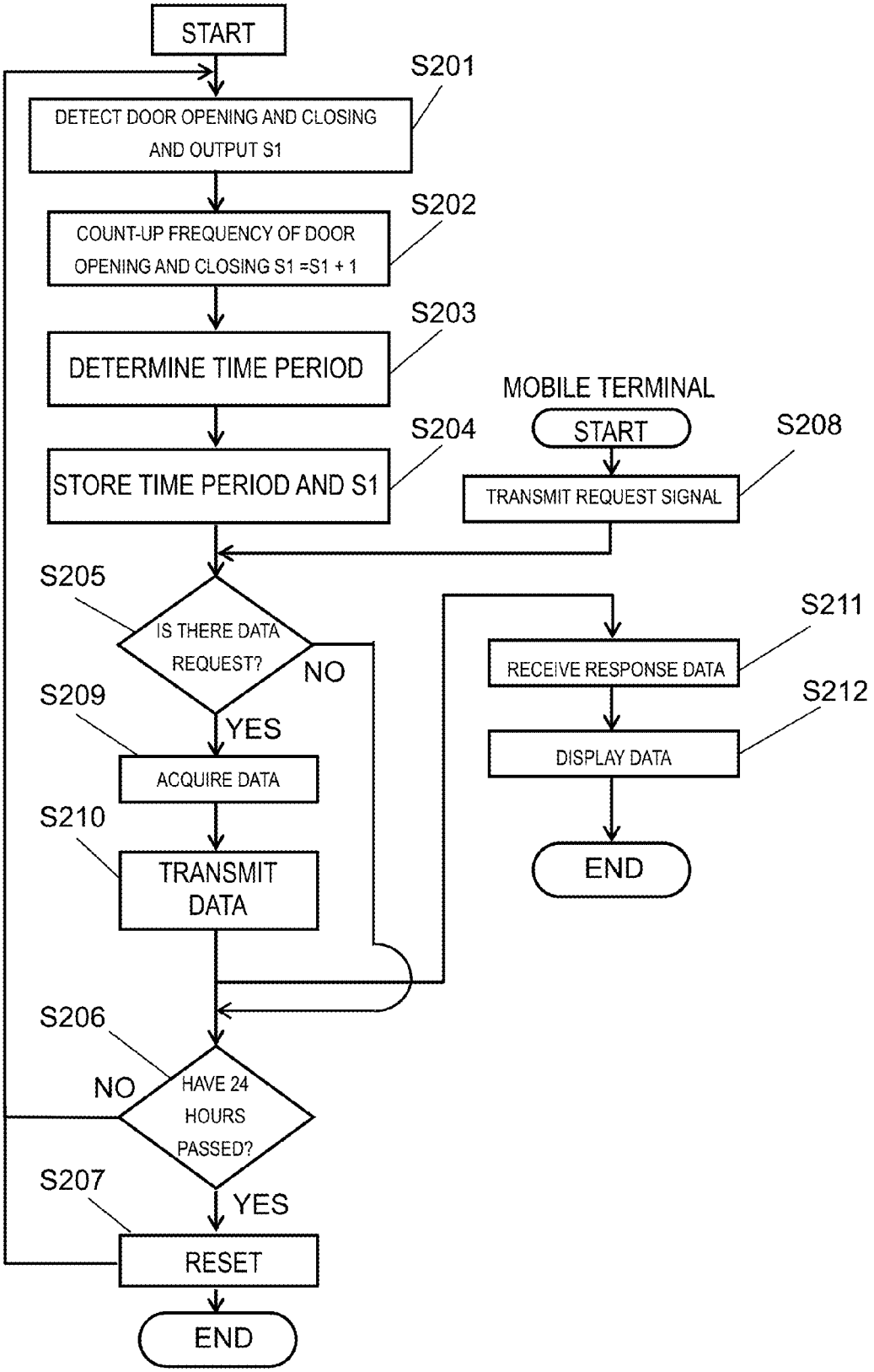
FIG. 14 is a flow chart for explaining operations in the refrigerator control unit of the refrigerator and the control unit of the mobile terminal in the third embodiment of the present invention.

In addition, FIG. 13 is a control block diagram illustrating configurations of a refrigerator control unit 1090 of refrigerator 1100 and a mobile terminal 122, and FIG. 14 is a flow chart for explaining operations in refrigerator control unit 1090 of refrigerator 1100 and control unit 138 of mobile terminal 122.

As illustrated in FIG. 9 and FIG. 10, Refrigerator 1100 includes refrigerator body 101 and a plurality of storage rooms. The plurality of storage rooms are configured to include, in an order from the top, refrigerating room 102, ice making room 103, temperature switching room 104 positioned at the side of ice making room 103, freezing room 105, and vegetable room 106. This layout can be appropriately changed if necessary. A set temperature in temperature switching room 104 can be switched in a range from approximately −18° C. which is a temperature in freezing room 105 to approximately 6° C. which is a temperature in vegetable room 106.

Refrigerator body 101 is configured to include outer box 101*a* in which an iron plate is mainly used, inner box 101*b* molded from resin such as ABS, and rigid polyurethane foam 101*c* filled and foamed in a space between outer box 101*a* and inner box 101*b*. In rigid polyurethane foam 101*c* of refrigerator body 101, in order to improve heat insulation, vacuum heat insulating material 101*d* is partially embedded, if necessary. For example, in the example illustrated in FIG. 10, vacuum heat insulating material 101*d* is affixed in the space of the rear surface portion corresponding to ice making room 103, temperature switching room 104, and freezing room 105, and thus, becomes a complex with rigid polyurethane foam 101*c*.

Top surface portion of the refrigerator body 101 has a shape having a step-shaped recess toward the rear surface direction of refrigerator 1100. In the step-shaped recess, machine room 107 is formed. In machine room 107, compressor 108 and high-pressure side components for freezing cycle such as a dryer for water removal, and a refrigerator control unit, are accommodated. In this way, the storage capacity of vegetable room 106 at the bottom can be expanded.

On the other hand, cooler 109 configures a low pressure side of the freezing cycle. A plurality of storage rooms are cooled by cooling air generated in cooler 109 being forcibly blown by cooling fan 110 disposed at the rear side of freezing room 105.

Refrigerating room 102, ice making room 103, temperature switching room 104, freezing room 105, and vegetable room 106 are configured so as to be open and closed by a plurality of doors 111 to 115 which are provided respectively corresponding thereto. Each of the plurality of doors 111 to 115 has handle portion 116. In addition, each of the plurality of doors 111 to 115, as similar to refrigerator body 101, is formed by rigid polyurethane foam 101*c* being filled and foamed in the inner portion sealed by the metal of the outer surface and the resin material of the inner surface such as ABS.

Furthermore, in a part of the outer surface of door 111, a substrate storage portion formed of the resin material is disposed, and inside the substrate cover, for example, operation unit 118 having a radio frequency identification (RFID) tag is disposed. By covering the RFID tag with the resin material, it is possible to prevent the electric transmission from being influenced by the metal.

The outer surface of door 111 may be formed of a glass material instead of the metal, and by closely disposing operation unit 118 inside the glass, it is also possible to prevent the electric transmission from being influenced by the metal.

Among the plurality of doors 111 to 115, at least on door 111 of refrigerating room 102, a corresponding door opening and closing detection unit 125 (refer to FIG. 13) is provided, and the frequency of the door opening and closing data and accumulated door opening time data are processed in refrigerator control unit 1090 (refer to FIG. 13).

In refrigerator 1100 in the present embodiment, door 111 of the refrigerating room 102 which is positioned on the uppermost portion of the refrigerator is a pair of double-door type doors, and is configured to include two doors 111*a* and 111*b* having different areas from each other disposed side by side. The butting surface portion of right and left side doors 111*a* and 111*b* is the most convex portion protruding to the frontmost side (refer to FIG. 11). At the end portion of right side door 111*b* which is the convex portion, for example, operation unit 118 is provided in the vertical direction. A DC wiring for the supplying power to operation unit 118 or for the transmission of the control signal is provided on right side door 111*b*. However, an AC wiring is not provided on right side door 111*b* but on left side door 111*a*. Right side door 111*b* includes automatic door opening and closing mechanism 117, and is configured so as to be opened only by slightly pressing the surface of door 111*b*. The door opening and closings can be detected by door opening and closing detection unit 125.

As illustrated in FIG. 12, operation unit 118 includes an electrostatic touch typed setting switch 119 for performing the temperature setting of each storage room, setting status display unit 120 disposed at the upper portion of setting switch 119, and data transmission unit 121 that outputs and transmits the frequency of door opening and closing data and accumulated door opening time data. Data transmission unit 121 is provided in a range of a height of 900 mm or higher and 1500 mm or lower from the bottom of refrigerator body 101.

As illustrated in FIG. 9 and FIG. 11, when the user causes mobile terminal 122 such as a mobile phone, a smart phone, or a PDA to approach data transmission unit 121, data transmission unit 121 transmits the data to mobile terminal 122. The transmitted data is displayed on display unit 139 (refer to FIG. 13) of mobile terminal 122. Display unit 139 of mobile terminal 122 configures the display means for displaying the frequency of door opening and closing.

In FIG. 13, a block diagram of mobile terminal 122 and refrigerator control unit 1090 of refrigerator 1100 is illustrated.

Refrigerator control unit 1090 includes door opening and closing detection unit 125, frequency counter unit 126, frequency storage unit 129, 24 hour timer 127, time period dividing unit 128, previous day data update unit 130, previous day data holding unit 130A, short distance communication detection unit 131, data transmission unit 121, and antenna unit 121A.

Frequency counter unit 126 counts the frequency of door opening and closing detected by door opening and closing detection unit 125.

Time period dividing unit 128 divides the time output from 24 hour timer 127 into a plurality of time periods. In the present embodiment, the time is divided into four time periods such as breakfast, lunch, dinner, and sleeping. For example, it is possible to set the time periods as: breakfast is from 06:00 to 11:00, lunch is from 11:00 to 16:00, dinner is from 16:00 to 23:00, and sleeping is from 23:00 to 06:00.

This is just an example, and the time can be changed. If the time periods can be set by the user in advance, it is possible to improve the usability.

Frequency storage unit 129 stores the frequency that is counted by frequency counter unit 126. Frequency storage unit 129 is configured so as to store the frequency output from frequency counter unit 126 for each time period, base on the output from the time period dividing unit 128.

Previous day data update unit 130 updates the frequency of door opening and closing stored in frequency storage unit 129 based on the time output from 24 hour timer 127, for each time period of 24 hours later.

Previous day data holding unit 130A stores and holds the data of previous day updated by previous day data update unit 130.

Data transmission unit 121 functions as an output unit for outputting the frequency of door opening and closing data, or the like, and is formed of an IC chip which is integrated with antenna unit 121A. Data transmission unit 121 is configured so as to transmit the frequency of door opening and closing data stored in frequency storage unit 129 and the frequency of door opening and closing data of previous day held in previous day data holding unit 130A, for each time period.

According to the above-described configuration, since the data is transmitted in collective form in a specific time period rather than a constant communication, the amount of data communication can be reduced, and the time for communication can be reduced, and thus, it is possible to reduce a risk that a communication error occurs. In this way, the improvement in reliability can be achieved and the user's feeling of operation can be improved.

When mobile terminal 122 such as a mobile phone, a smart phone, or a PDA approaches short distance communication detection unit 131 and requests the data, short distance communication detection unit 131 detects the data request. When the data request is detected, short distance communication detection unit 131 supplies the power to data transmission unit 121 to operate.

Therefore, when mobile terminal 122 approaches and requests the data, data transmission unit 121 is brought into an operation state by short distance communication detection unit 131, and the data of the recent frequency of door opening and closing or the like stored in frequency storage unit 129 is transmitted to the outside from antenna unit 121A.

Next, the configuration mobile terminal 122 will be described. In the present embodiment, a typical mobile phone is used as mobile terminal 122.

Mobile terminal 122 includes first communication unit 132 that performs a proximity communication and antenna 133 thereof, second communication unit 134 for the voice call and the internet communication and antenna 134A thereof, and control unit 138 that includes first communication control unit 135 and second communication control unit 136 which control the above-described communication units respectively and display control unit 137.

Mobile terminal 122 further includes display unit 139 such as a liquid crystal display, operation unit 140 such as a touch switch, storage unit 141, and the like.

By the operation of operation unit 140, when mobile terminal 122 is switched to the proximity communication by first communication control unit 135 from the communication by second communication control unit 136, mobile terminal 122 transmits the data request signal to the opposite party and comes into the state capable of receiving the data from the opposite party. Then, display control unit 137 switches the display of display unit 139, and then displays the data received by first communication unit 132 on display unit 139.

That is, by causing antenna 133 of first communication unit 132 to approach data transmission unit 121 of refrigerator 1100, mobile terminal 122 can receive the frequency of the door opening and closing data or the like from data transmission unit 121, and can display the data on display unit 139.

There are various means for the proximity communication between mobile terminal 122 and data transmission unit 121 other than the means in which the RFID is used, and any one of the infrared communication, a wireless LAN, or Bluetooth® may be used. Considering the situation of a the commercial mobile phone or the smart phone is used, it is preferable to use the proximity communication means in which the mobile phones and the smart phones can perform the exchanging of the data such as the telephone numbers. In the present embodiment, the short distance communication method like this is adopted.

In information system 1150 with the configuration described above, the operation thereof will be described using FIG. 14.

First, it is assumed that the user opens the door of refrigerator 1100, for example, right side door 111*b* of refrigerating room 102 in order to put the storage foods in or out. Then, door opening and closing detection unit 125 detects the door opening and closing, and outputs signal S1 to door opening and closing counter unit 126 (S201).

Frequency counter unit 126, when receiving signal S1, adds the increment "+1" to the counted number which is the frequency of the door opening and closing, and outputs the result to frequency storage unit 129 (S202).

Frequency counter unit 126 determines the time period based on the time period determination signal output from time period dividing unit 128 (S203).

Frequency storage unit 129 stores the frequency of door opening and closing during the period determined in STEP S203, that is, the frequency to which "+1" is added as described above (S204).

Short distance communication detection unit 131 checks whether there is a data request from mobile terminal 122 or not (S205). If there is no data request (No in S205), the process proceeds to S206, and then 24 hour timer 127 checks whether one day (24 hours) has passed or not. If one day has not passed (No in S206), the process returns to S201.

On the other hand, in STEP S206, if one day has passed (Yes in S206), the frequency of door opening and closing which has been stored up to that time is reset (S207), and the process returns to S201.

If the user causes antenna 133 portion of mobile terminal 122 to approach data transmission unit 121 on door 111*b* of refrigerator 1100, and mobile terminal 122 transmits the data request signal (S208), short distance communication detection unit 131 detects the signal, and data transmission unit 121 starts to operate (Yes in S205).

Specifically, data transmission unit 121 acquires the frequency of door opening and closing during the time period stored in frequency storage unit 129 (S209).

Data transmission unit 121 transmits the acquired data to mobile terminal 122 (S210). For example, if the time period when the mobile terminal 122 approaches is the breakfast time period, the frequency of door opening and closing of the day from the time when the breakfast time period starts and the frequency of door opening and closing of the previous day are acquired, and the data is transmitted.

Mobile terminal 122 receives the transmitted data (S211) and displays the data on display unit 139 (S212).

At this time, the user can be aware of the frequency of door opening and closing in the time period by viewing display unit 139. In this way, when the frequency of door opening and closing is high, the user can be careful to reduce the frequency of door opening and closing after that time, and therefore, the power saving can be promoted. What is displayed on display unit 139 is the frequency of door opening and closing for each time period, for example, if the time period is the breakfast time period, the frequency of door opening and closing in the breakfast time period is displayed. In this way, since the frequency of door opening and closing in the breakfast time period can be accurately ascertained, it is possible for the user to accurately ascertain whether the frequency of door opening and closing in the breakfast time period is high or low. Furthermore, it is possible to be aware of the frequency compared with that of the previous day. That is, since the frequencies of the same time period of the day and the previous day are displayed on display unit 139, the user can accurately ascertain the increase or decrease of the frequency during the same time period in comparison with the previous day.

In addition, since the frequency of door opening and closing is displayed on mobile terminal 122 side, it is possible to remove the display device for displaying the frequency of door opening and closing at refrigerator 1100 side. Furthermore, even if the display device is provided, when the frequency of door opening and closing reaches a predetermined value, since the display device may only perform display sufficient for notifying that fact, therefore, it is possible to reduce the power consumption of refrigerator 1100 itself.

In the present embodiment, the display device on refrigerator 1100 side for notifying the frequency of door opening and closing is removed, and the display power for notifying the user of the frequency of door opening and closing is not needed. In this way, the power can further be saved, and it is possible to promote the energy saving in refrigerator 1100.

Furthermore, in the present embodiment, short distance communication detection unit 131 is provided at refrigerator 1100 side, and only in a case where short distance communication detection unit 131 detects that the data is requested, the power is supplied to data transmission unit 121 and the data is transmitted. In this way, in a case where there is no data request, data transmission unit 121 does not consume the power, and it is possible to further achieve the energy saving by that much.

Furthermore, in the present embodiment, the user can check the frequency of the door opening and closing or the like, for example, by displaying the frequency of the door opening and closing on a personal computer at the company using the internet line via second communication unit 134 of mobile terminal 122. In this way, the user can call the children or grandfather at home to pay attention for reducing the frequency of opening and closing the door of refrigerator 100.

In addition, in refrigerator 1100 in the present embodiment, data transmission unit 121 is provided on the most convex portion of the door surface (refer to FIG. 11). In this way, mobile terminal 122 can approach or be in contact with data transmission unit 121, and it is possible to secure the reliable communication performance. Furthermore, it is possible to maintain a good external appearance of the door for a long time without damaging the external appearance of the door in the peripheral edge of data transmission unit 121 by mobile terminal 122.

In addition, data transmission unit 121 is provided on door 111 of the storage room which is on the highest position of refrigerator 1100, that is, provided on door 111 of uppermost storage room among a plurality of storage rooms. In this way, there is no such a failure as in the case of providing data transmission unit 121 on the doors located at the lower part, that is, a failure that the cooling air leaked and fell down when the door positioned upper than the door on which data transmission unit 121 is provided is opened touches data transmission unit 121, and the condensation occurs on the surface of data transmission unit 121, and thus, the communication state deteriorates and the component reliability decreases.

In addition, data transmission unit 121 is provided on door 111 which corresponds to refrigerating room 102 among a plurality of storage rooms. Since the temperature in refrigerating room 102 is higher than that in ice making room 103 or freezing room 105, it is possible to suppress the influence of the cooling air in the room on data transmission unit 121 to be small. That is, since the difference in temperature between the surface and the inner portion of data transmission unit 121 is suppressed to be small, and the occurrence of the condensation can be suppressed, it is possible to reduce the failure such as the deterioration of the communication state and the decrease of the component reliability.

In addition, data transmission unit 121 is incorporated into operation unit 118 provided at the end portion of right side door 111*b*. In this way, even if the affixing of the sticker to door 111 performed by the user on a daily basis is performed at the center portion of the door, the risk of occurrence of the communication failure caused by the sticker which covers the surface of data transmission unit 121 can be reduced, and it is possible to reliably secure the communication performance.

In addition, data transmission unit 121 is provided on right side door 111*b* having the larger size among the double-door type doors 111 of the storage room. In this way, it is possible to reduce the occurrence of the failure in data transmission unit 121 due to the cooling air in the refrigerating room. There are more right-handed users than the left-handed users and the frequency of the opening and closing right side door 111*b* by the right-handed user is high. In a case where right side door 111*b* is opened and the cooling air in the refrigerating room leaks out, there is a high possibility that the cooling air diffuses in the surface of left side door 111*a* at the opposite side of right side door 111*b*, and thus, the possibility that the cooling air goes around into the surface side of right side door 111*b* (data transmission unit 121 installed side) which is the rear side seen from the leaked cooling air, is very low. Therefore, there is almost no possibility that the cooling air touches data transmission unit 121 provided on right side door 111*b*, and it is possible to suppress the failure such as the deterioration of the communication state and the decrease of the component reliability due to the condensation occurring on the surface of data transmission unit 121. The door having the larger size is opened, cooling air leaks out the more. Therefore, it is advantageous to provide data transmission unit 121 on right side door.

In addition, only the DC wiring is provided on the door on which data transmission unit 121 is provided and the AC wiring is not provided. In this way, the transmission of data transmission unit 121 is not interfered by the noise occurred from the AC wiring, and thus, it is possible to secure the accurate and reliable communication performance.

Furthermore, on right side door 111*b* of the storage room, on which data transmission unit 121 is provided, corresponding automatic door opening and closing mechanism 117 is provided. Moreover, data transmission unit 121 is disposed at the position separated from handle portions 116 respectively provided on doors 111 to 115 and the position higher than handle portion 116. In this way, even if the user touches door 111*b* with the wet hand, the amount of water drops on the wet hand attaching to door 111*b* is small, and since handle portion 116 is separated from data transmission unit 121, data transmission unit 121 does not get wet by the water drops, and thus, it is possible to reduce the failure such as the deterioration of the communication state and the decrease of the component reliability.

Fourth Embodiment

Next, a fourth embodiment of the present invention will be described.

Figure 15A:
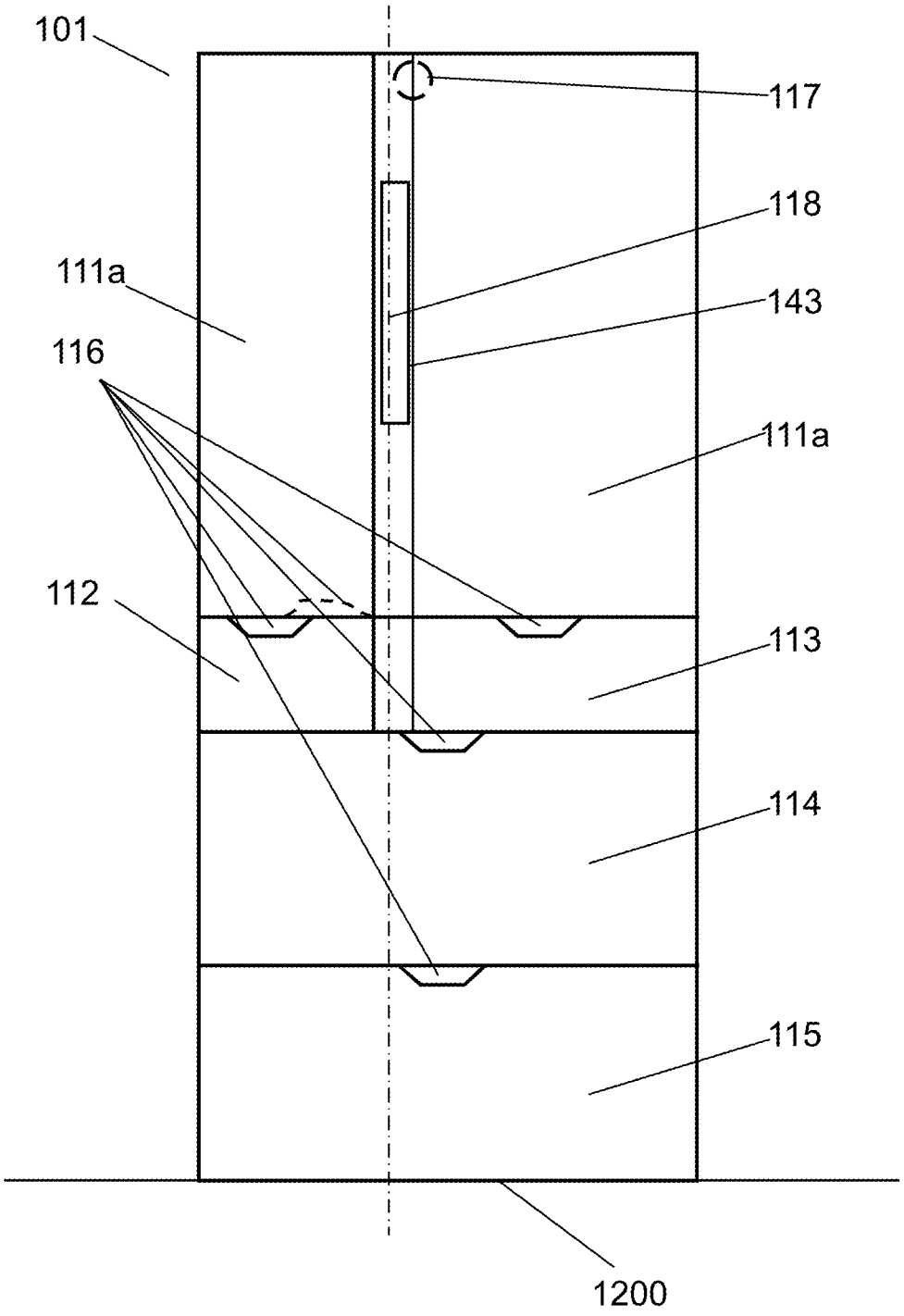
FIG. 15A is a front view illustrating a configuration of a refrigerator in a fourth embodiment of the present invention.

FIG. 15A is a front view illustrating a configuration of refrigerator 1200 in a fourth embodiment of the present invention. In addition, FIG. 15B is a functional block diagram of refrigerator control unit 1190 of refrigerator 1200.

In the present embodiment, the components common to those of refrigerator 1100 in the third embodiment will be referenced by the same numeral numbers, and the descriptions thereof will be omitted.

As illustrated in FIG. 15A, in refrigerator 1200, display unit 143 for displaying the frequency of door opening and closing or the like is provided on right side door 111*b* of refrigerator body 101.

Figure 15B:
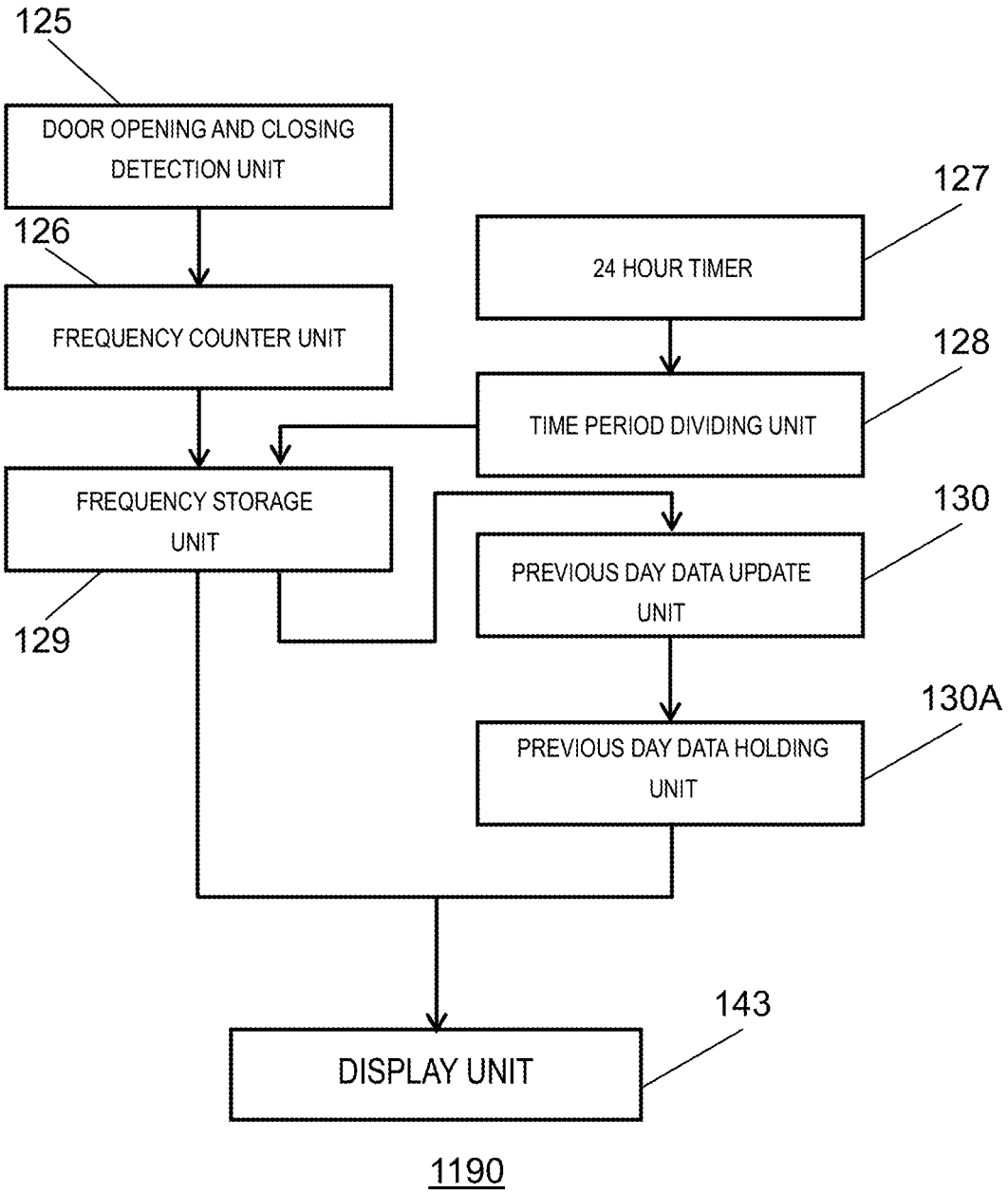
FIG. 15B is a functional block diagram of a refrigerator control unit of the refrigerator in the fourth embodiment of the present invention.

As illustrated in FIG. 15B, refrigerator 1200 in the present embodiment has a different configuration compared to refrigerator 1100 in the third embodiment in the point that control unit 1190 includes display unit 143 instead of short distance communication detection unit 131, data transmission unit 121, and antenna unit 121A.

On display unit 143, the frequency of door opening and closing data or the like stored in frequency storage unit 129 and the frequency of door opening and closing data or the like of the previous day stored in previous day data holding unit 130A are displayed for each time period.

By using such refrigerator 1200, as similar to refrigerator 1100 in the third embodiment, the user can be aware of the frequency of door opening and closing for each time period, for example, in a case of the breakfast time period, the frequency of door opening and closing during the breakfast time period together with the frequency of door opening and closing of the previous day by viewing display unit 143. Accordingly, when the frequency of door opening and closing is high, the user can be careful to reduce the frequency of door opening and closing after that time, and therefore, the power saving can be promoted.

As described above, according to the configurations of refrigerator 1100 and refrigerator 1200 described in the third and fourth embodiments respectively, frequency of door opening and closing can be appropriately displayed, and thus, it is possible to promote the energy saving.

The configurations described in the third embodiment and the fourth embodiment are some aspects for realizing the present invention, and various modifications can be made within the objective scope of the present invention.

For example, in the present embodiment described above, the data provided to the user is the frequency of door opening and closing for the power saving education. However, the accumulated door opening time may be provided, or both of them may be provided.

In addition, in the configuration described above, time period dividing unit 128 divides the time into four time periods such as breakfast (06:00 to 12:00), lunch (12:00 to 18:00), dinner (18:00 to 24:00), and sleeping (24:00 to 06:00). However, the present invention is not limited thereto. For example, the time may be divided into two time periods such as day time and night time, or the sleeping time period may be further added to the above. In any cases, since the user can accurately know the frequency of door opening and closing in each time period, it is possible to exert the power saving effect more effectively. Particularly, in a case where the sleeping time period is included in dividing and the data of that time period is displayed, the fact that there are many door opening and closing during the sleeping time period can be analyzed, and it is possible to arouse the family members to be careful to reduce the frequency of door opening and closing during the sleeping time period which is usually not observed, and thus, it is possible to improve the power savings.

In addition, in the third embodiment, data transmission unit 121 is described as having only a transmission function. However, a data transmission and receiving unit that also has a receiving function can be used. For example, applications can be considered, in which the frequency of door opening and closing data and the like from refrigerator control unit 1090, which enables the internal temperature to be set by transmitting the set temperature data to data transmission unit 121 from mobile terminal 122 side, is received by the transmission and receiving unit through the short distance wireless communication, not through the wiring and the like.

In a case where the transmission and receiving unit having a function of transmission and receiving as data transmission unit 121 is used, in corresponding to the transmission and receiving unit provided on door 111, a transmission and receiving unit can also be provided on refrigerator body 101 side. In the configuration, when door 111 is opened, the transmission and receiving unit on refrigerator body 101 side detects the opening, that is, the transmission and receiving unit on door 111 serves as door opening and closing detection unit 125 also. In this way, it is possible to simplify the configuration.

It is preferable that door opening and closing detection unit 125 be provided corresponding to all doors 111 to 115. However, for example, door opening and closing detection unit 125 may be provided on one or a part of doors of which the frequency of opening and closing is high.

Fifth Embodiment

Next, a fifth embodiment of the present invention will be described. In the present embodiment, an example of providing data transmission and receiving unit 221 on refrigerator 2100, which transmits the frequency of door opening and closing data or the like to the outside, will be described. A configuration in which, by causing mobile terminal 222 such as a mobile phone to approach data transmission unit 221, the average door opening time data is displayed on display unit 239 (refer to FIG. 20) of mobile terminal 222, or the control data of refrigerator 2100 from mobile terminal 222 is transmitted to data transmission unit 221, will be described. Information system 2150 is configured to include refrigerator 2100 and mobile terminal 222.

Figure 16:
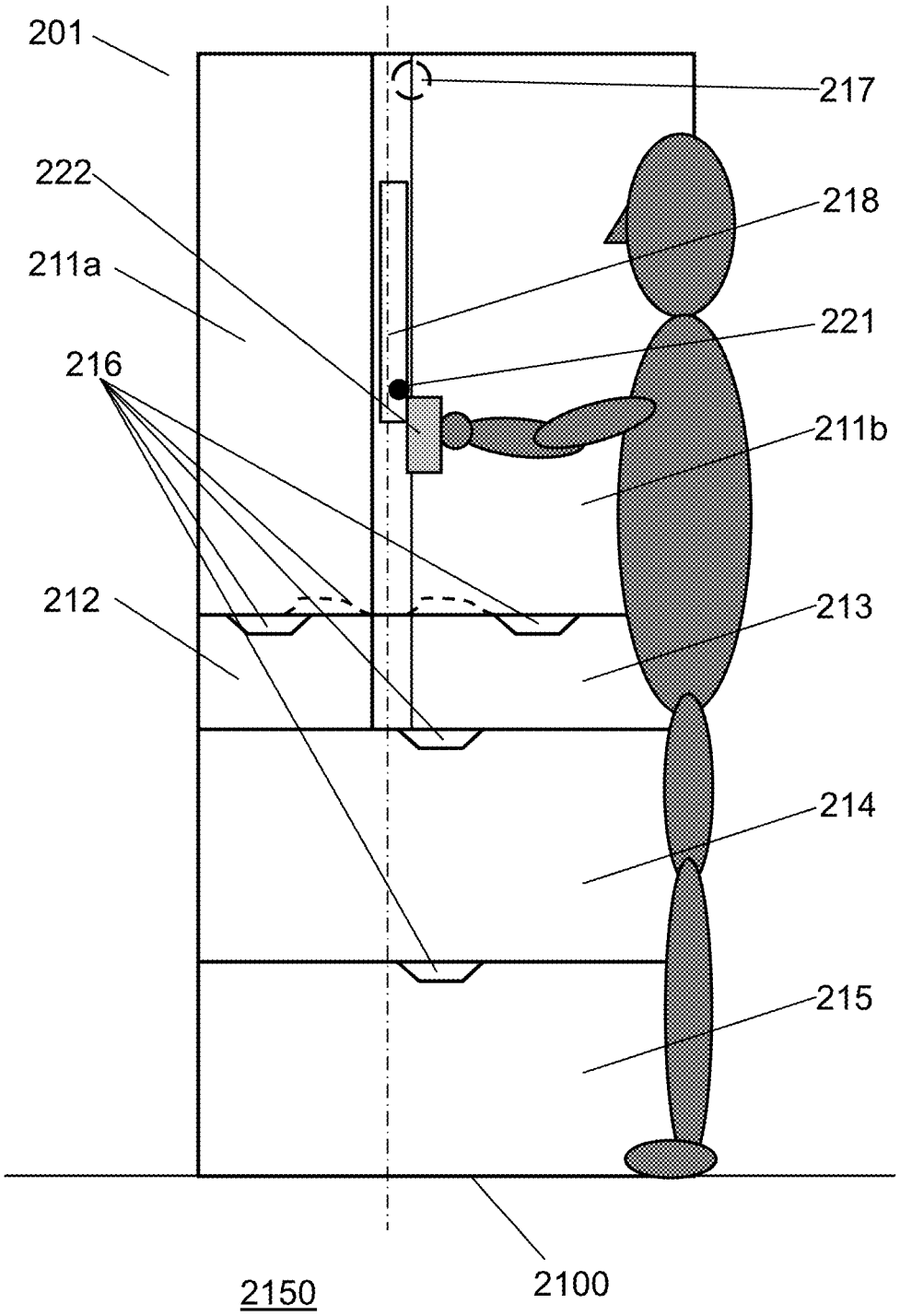
FIG. 16 is a front view illustrating a status of using a refrigerator in a fifth embodiment of the present invention.
Figure 17:
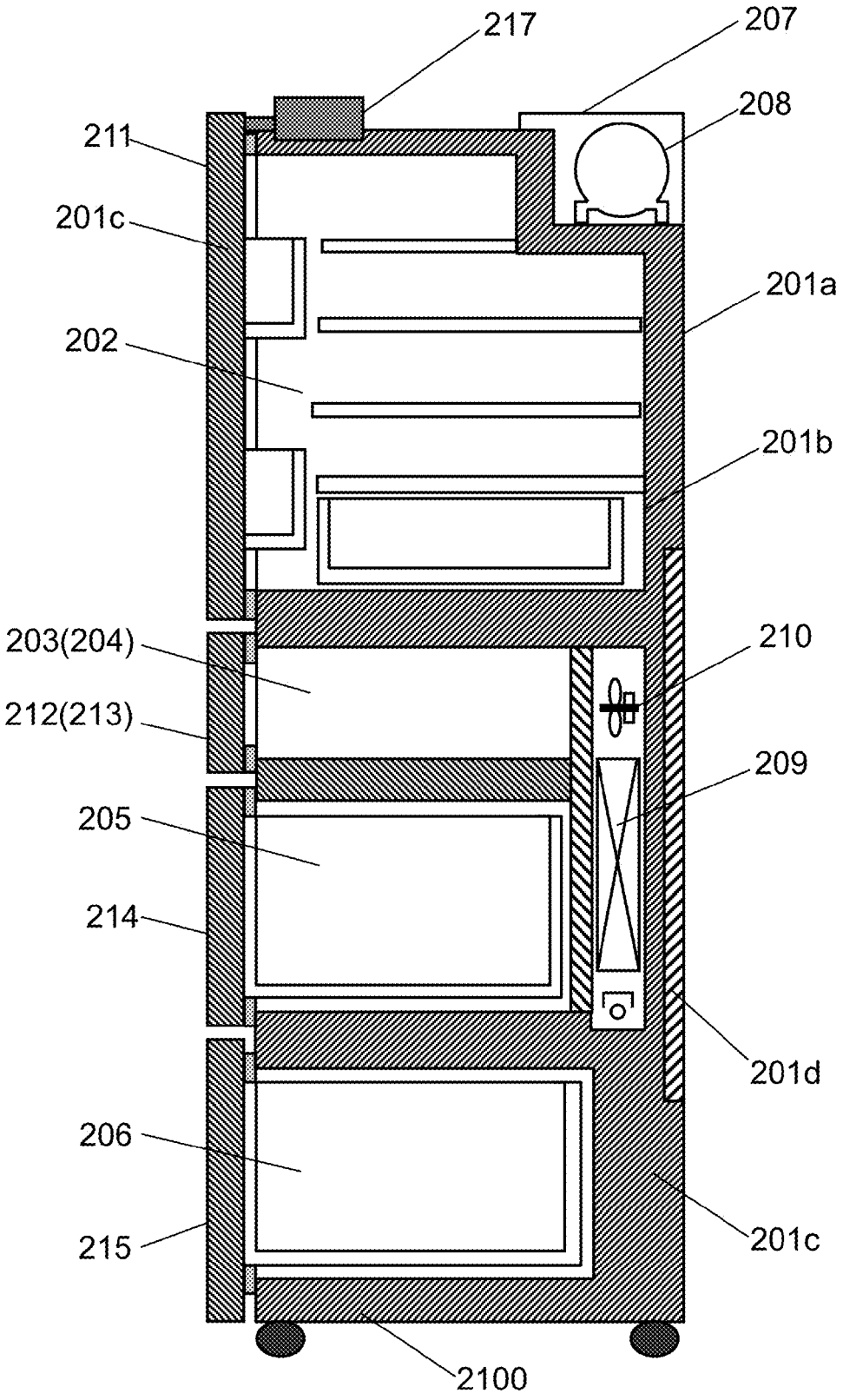
FIG. 17 is a sectional view illustrating a schematic configuration of the refrigerator in the fifth embodiment of the present invention.
Figure 18:
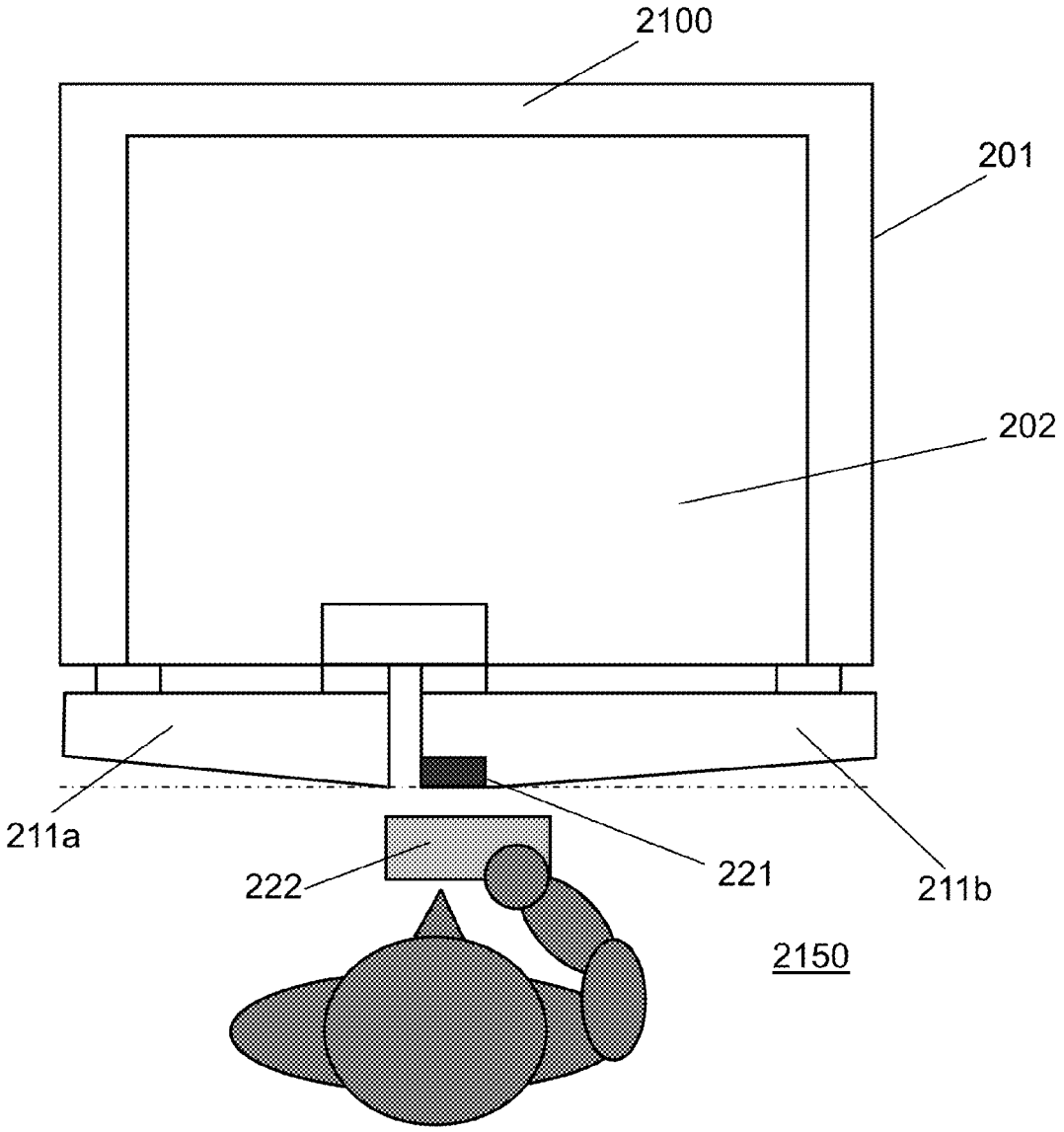
FIG. 18 is a plan view illustrating a schematic sectional configuration of the refrigerator in the fifth embodiment of the present invention.
Figure 19:
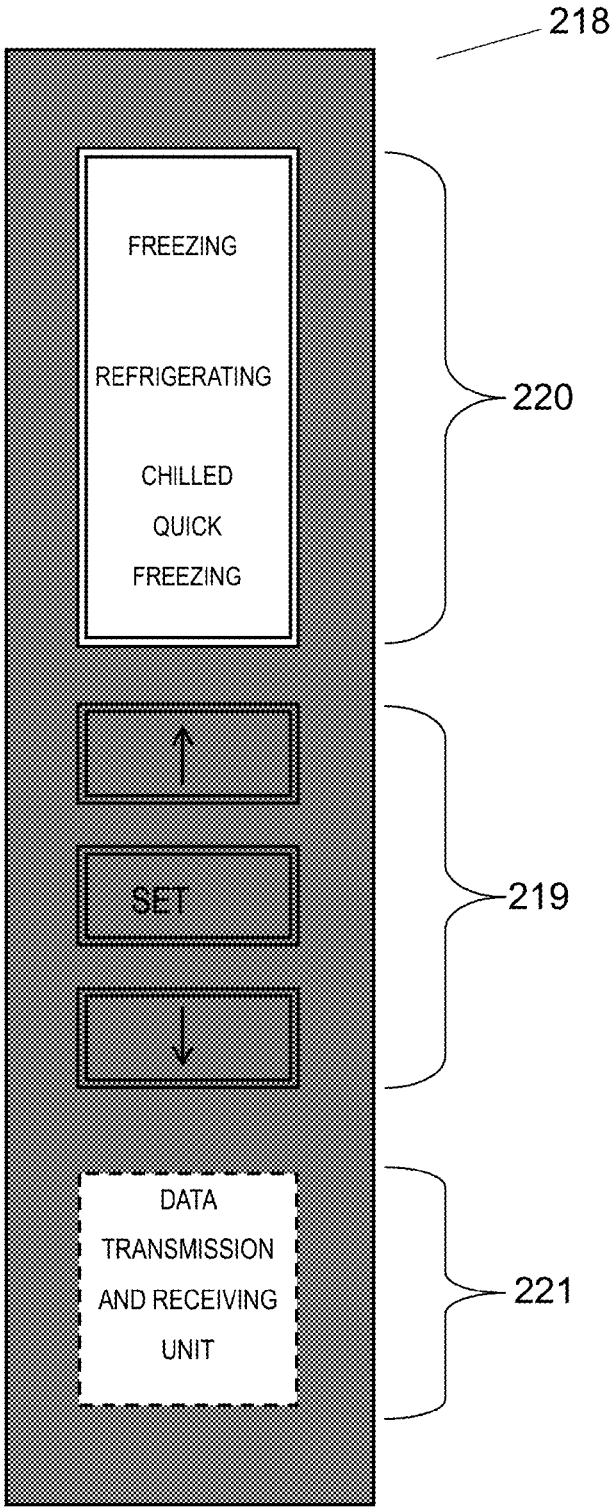
FIG. 19 is a front view illustrating a configuration of an operation unit of the refrigerator in the fifth embodiment of the present invention.
Figure 20:
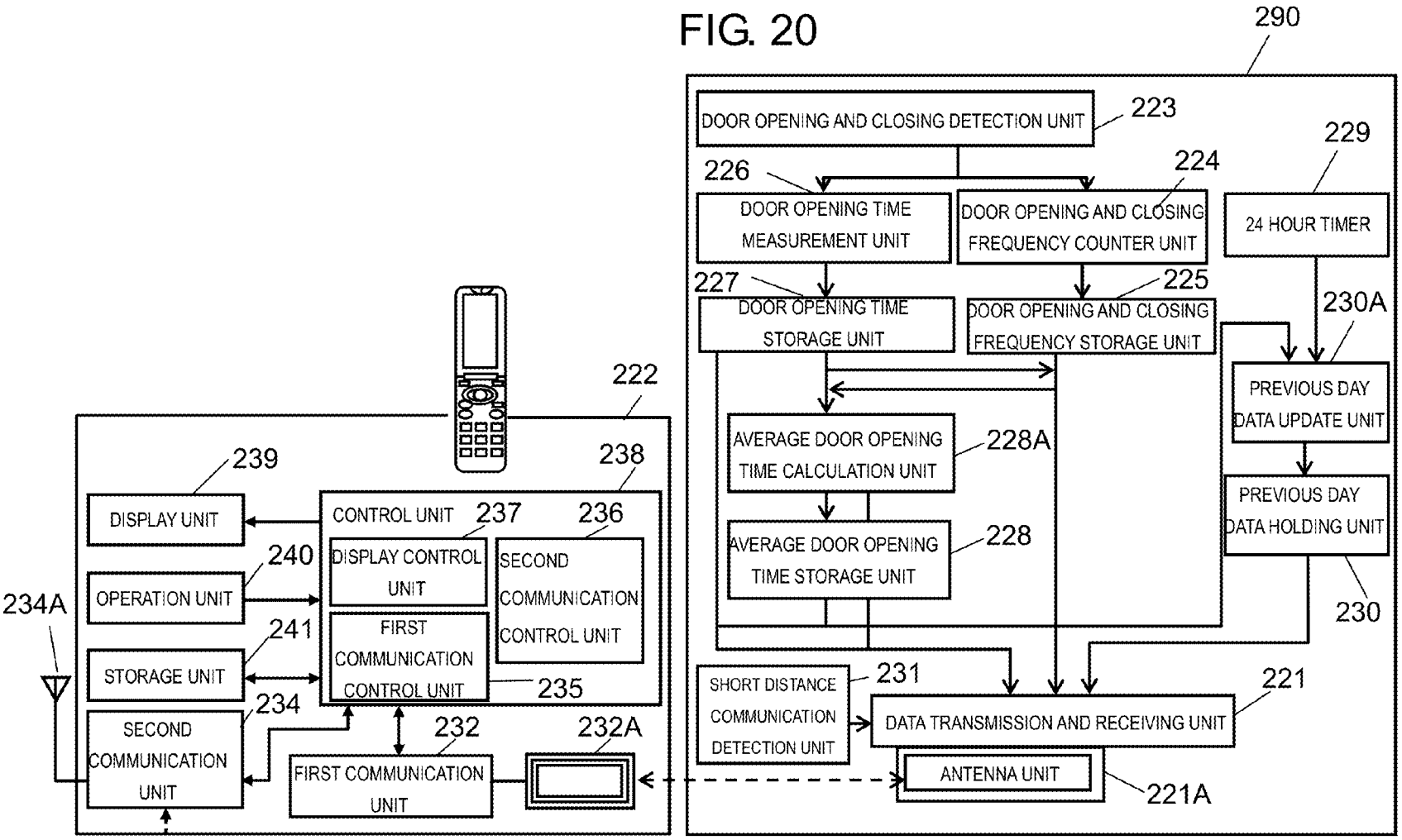
FIG. 20 is a control block diagram illustrating configurations of a refrigerator control unit of the refrigerator and a mobile terminal in the fifth embodiment of the present invention.
Figure 21:
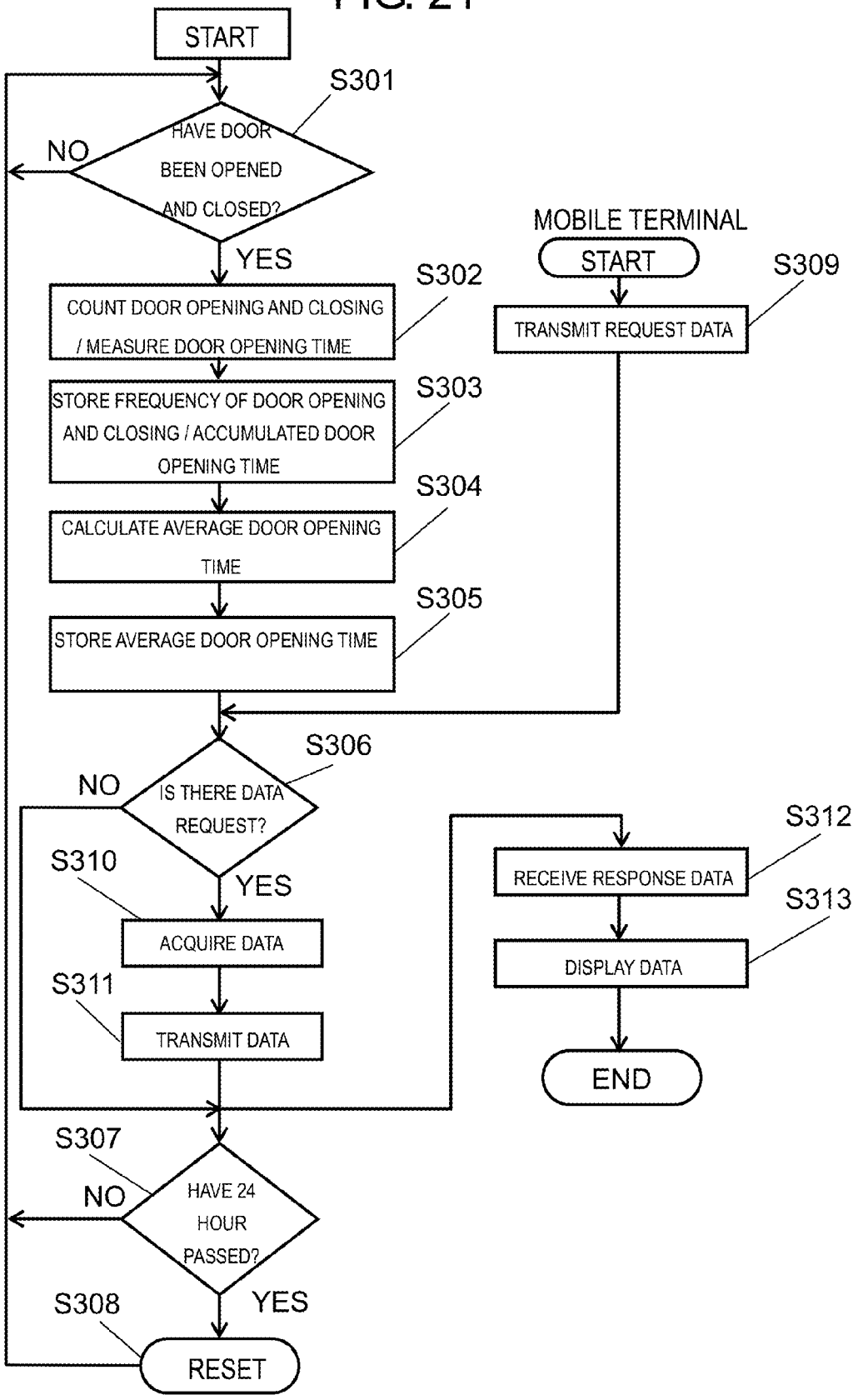
FIG. 21 is a flow chart for explaining operations in the refrigerator control unit of the refrigerator and the control unit of the mobile terminal in the fifth embodiment of the present invention.

FIG. 16 is a front view illustrating a status of using refrigerator 2100 in the fifth embodiment of the present invention, FIG. 17 is a sectional view illustrating a schematic configuration of refrigerator 2100, FIG. 18 is a plan view illustrating a schematic sectional configuration of refrigerator 2100, and FIG. 19 is a front view illustrating configuration of an operation unit 218 of refrigerator 2100. In addition, FIG. 20 is a control block diagram illustrating configurations of a refrigerator control unit 290 of refrigerator 2100 and a mobile terminal 222, and FIG. 21 is a flow chart for explaining operations in refrigerator control unit 290 of refrigerator 2100 and control unit 238 of mobile terminal 222.

As illustrated in FIG. 16 and FIG. 17, Refrigerator 2100 includes refrigerator body 201 and a plurality of storage rooms. The plurality of storage rooms are configured to include, in an order from the top, refrigerating room 202, ice making room 203 and temperature switching room 204 positioned at the side of ice making room 203, freezing room 205, and vegetable room 206. This layout can be appropriately changed if necessary. A set temperature in temperature switching room 204 can be switched in a range from approximately −18° C. which is a temperature in freezing room 205 to approximately 6° C. which is a temperature in vegetable room 206.

Refrigerator body 201 is configured to include outer box 201*a* in which an iron plate is mainly used, inner box 201*b* molded from resin such as ABS, and rigid polyurethane foam 201*c* being filled and foamed in a space between outer box 201*a* and inner box 201*b*. In rigid polyurethane foam 201*c* of refrigerator body 201, in order to improve heat insulation, vacuum heat insulating material 201*d* is partially embedded, if necessary. For example, in the example illustrated in FIG. 17, vacuum heat insulating material 201*d* is affixed in the space of the rear surface portion corresponding to ice making room 203, temperature switching room 204, and freezing room 205, and thus, becomes a complex with rigid polyurethane foam 201*c*.

Top surface portion of the refrigerator body 201 has a shape having a step-shaped recess toward the rear surface direction of refrigerator 2100. In the step-shaped recess, machine room 207 is formed. In machine room 207, compressor 208, high-pressure side components for freezing cycle such as a dryer for water removal, and a refrigerator control unit, are accommodated. In this way, the storage capacity of vegetable room 206 at the bottom can be expanded.

On the other hand, cooler 209 configures a low pressure side of the freezing cycle. A plurality of storage rooms are cooled by cooling air generated in cooler 209 being forcibly blown by cooling fan 210 disposed at the rear side of freezing room 205.

Refrigerating room 202, ice making room 203, temperature switching room 204, freezing room 205, and vegetable room 206 are configured so as to be open and closed by doors 211 to 215 which are provided respectively corresponding thereto. Each of the plurality of doors 211 to 215 has handle portion 216. In addition, each of the plurality of doors 211 to 215, as similar to refrigerator body 201, is formed by rigid polyurethane foam 201*c* being filled and foamed in the inner portion sealed by the metal of the outer surface and the resin material of the inner surface such as ABS.

Among a plurality of doors 211 to 215, at least on door 211 of refrigerating room 202, corresponding door opening and closing detection unit 223 (refer to FIG. 20) is provided, and the frequency of the door opening and closing data and accumulated door opening time data are processed in refrigerator control unit 290 (refer to FIG. 20).

In refrigerator 2100 in the present embodiment, door 211 of the refrigerating room 202 which is positioned on the uppermost portion of the refrigerator is a pair of double-door type doors, and is configured to include door 211*a* and 211*b* having different areas from each other disposed side by side. The abutting surface portion of right and left side doors 211*a* and 211*b* is the most convex portion protruding to the frontmost side (refer to FIG. 18). At this convex shaped portion, for example, the end portion of right side door 211*b* (which is the abutting surface portion of left side door 211*a*), operation unit 218 is provided in the vertical direction.

As illustrated in FIG. 19, operation unit 218 includes an electrostatic touch typed setting switch 219 for performing the temperature setting of each storage room, setting status display unit 220 disposed at the upper portion of setting switch 219, and data transmission unit 221. Data transmission and receiving unit 221 formed of a radio frequency identification (RFID) tag is provided on refrigerator 2100. In the present embodiment, the RFID tag used as data transmission and receiving unit 221 is a passive type and has a communication distance of 100 mm or less.

Data transmission and receiving unit 221 performs the data transmission and receiving to and from mobile terminal 222 such as a mobile phone, a smart phone, or a PDA. For example, data transmission and receiving unit 221 outputs and transmits the data such as the average door opening time, the frequency of door opening and closing, or the accumulated door opening time to mobile terminal 222, or conversely receives the data such as the set temperature sent from mobile terminal 222 via the internet communication.

In FIG. 20, a block diagram of mobile terminal 222 and refrigerator control unit 290 of refrigerator 2100 is illustrated.

Refrigerator control unit 290 includes door opening and closing detection unit 223, door opening time measurement unit 226, door opening time storage unit 227, door opening and closing frequency counter unit 224, door opening and closing frequency storage unit 225, average door opening time calculation unit 228A, average door opening time storage unit 228, 24 hour timer 229, previous day data update unit 230A, previous day data holding unit 230, short distance communication detection unit 231, data transmission unit 221, and antenna unit 221A.

Door opening and closing frequency counter unit 224 counts the frequency of door opening and closing detected by door opening and closing detection unit 223.

Door opening and closing frequency storage unit 225 stores the frequency of door opening and closing counted by door opening and closing frequency counter unit 224.

Door opening time measurement unit 226 measures the door opening time (the time during which the door is open) when the door is opened or closed, detected by door opening and closing detection unit 223.

Door opening time storage unit 227 accumulates and stores the door opening time measured by door opening time measurement unit 226.

Average door opening time calculation unit 228A divides the accumulated door opening time stored in door opening time storage unit 227 by the frequency of door opening and closing stored in door opening and closing frequency storage unit 225 and calculates the average door opening time.

Average door opening time storage unit 228 stores the average door opening time calculated by average door opening time calculation unit 228A.

Previous day data update unit 230A updates the average door opening time stored in average door opening time storage unit 228, the accumulated door opening time stored in door opening time storage unit 227, and the frequency of door opening and closing stored in door opening and closing frequency storage unit 225 based on the output from 24 hour timer 229 for each day.

Previous day data holding unit 230 stores the data of previous day updated by previous day data update unit 230A.

Data transmission and receiving unit 221 functions as an output unit for outputting the data of the average door opening time or the like, and is formed of an RFID tag or the like which is integrated with antenna unit 221A. When mobile terminal 222 such as a mobile phone, a smart phone, or a PDA approaches short distance communication detection unit 231 and requests the data, short distance communication detection unit 231 detects the fact that there is a data request. When data request from mobile terminal 222 is detected, short distance communication detection unit 231 causes data transmission and receiving unit 221 to induce the electricity (supplies the power) to operate.

Therefore, when mobile terminal 222 approaches and requests the data, data transmission and receiving unit 221 is brought into an operation state by short distance communication detection unit 231, and the above-described recent data and the like stored in each storage unit are transmitted to the outside from antenna unit 221A.

Next, the configuration of mobile terminal 222 will be described. In the present embodiment, a typical mobile phone is used as mobile terminal 222.

Mobile terminal 222 includes first communication unit 232 that performs a proximity communication and antenna 232A thereof, second communication unit 234 for voice calls and the internet communication and antenna 234A thereof, and control unit 238 that includes first communication control unit 235 and second communication control unit 236 which control above-described communication units respectively and display control unit 237.

Mobile terminal 222 further includes display unit 239 such as a liquid crystal display, operation unit 240 such as a touch switch, storage unit 241, and the like.

By the operation of operation unit 240, when mobile terminal 222 is switched to the proximity communication by first communication control unit 235 from communication by second communication control unit 236, mobile terminal 222 transmits the data request signal to the opposite party and comes into the state capable of receiving the data from the opposite party. Then, display control unit 237 switches the display of display unit 239, and then displays the data received by first communication unit 232 on display unit 239.

That is, by causing antenna 232A of first communication unit 232 to approach data transmission and receiving unit 221 of refrigerator 2100, mobile terminal 222 can receive the frequency of the door opening and closing data or the like from data transmission unit 221, and can display the data on display unit 239.

There are various means for the proximity communication between mobile terminal 222 and data transmission and receiving unit 221 other than the means in which the RFID is used, and any one of the infrared communication, a wireless LAN, or Bluetooth® may be used. Considering the situation that the commercial mobile phone or the smart phone is used, it is preferable to use the proximity communication means in which the mobile phones and the smart phones can perform the exchanging of the data such as the telephone numbers. In the present embodiment, the short distance communication method like this is adopted.

In information system 2150 with the configuration described above, the operation thereof will be described using FIG. 21.

First, it is assumed that the user opens the door of refrigerator 2100, for example, right side door 211*b* of refrigerating room 202 in order to take the storage foods in or out. Then, door opening and closing detection unit 223 detects the door opening and closing (Yes in S301), door opening and closing frequency counter unit 224 counts frequency of the door opening and closing, and door opening time measurement unit 226 measures the measures to accumulate the door opening time (S302).

The frequency of door opening and closing is stored in door opening and closing frequency storage unit 225 and the accumulated door opening time is stored in door opening time storage unit 227 (S303).

Average door opening time calculation unit 228A calculates the average door opening time at that time point (S304), and the calculated average door opening time is stored in average door opening time storage unit 228 (S305).

In STEP S306, short distance communication detection unit 231 checks whether there is a data request from mobile terminal 222 or not. If there is no data request (No in S306), 24 hour timer 229 checks whether one day (24 hours) has passed or not (S307). If one day has not passed (No in S307), the process returns to S301.

On the other hand, in STEP S307, if one day has passed (Yes in S307), the frequency of door opening and closing which has been stored up to that time is reset (S308), and the process returns to S301.

If the user causes antenna 232A portion of mobile terminal 222 to approach data transmission and receiving unit 221 on door 211*b* of refrigerator 2100, and mobile terminal 222 transmits the data request signal (S309). Then, short distance communication detection unit 231 detects the signal, and data transmission and receiving unit 221 starts to operate (Yes in S306).

Specifically, data transmission and receiving unit 221 acquires the average door opening time stored in average door opening time storage unit 228, the frequency of door opening and closing stored in door opening and closing frequency counter unit 224, and the accumulated door opening time stored in door opening time storage unit 227 (S310).

Data transmission and receiving unit 221 transmits the acquired data to mobile terminal 222 (S311). Mobile terminal 222 receives the transmitted average door opening time, the frequency of door opening and closing, and the accumulated door opening time, and sends the data to display unit 239 (S312).

Mobile terminal 222 displays the data received in STEP S312 on display unit 239 (S313).

At this time, the user can be aware of the average door opening time of the day and the frequency of door opening and closing and the accumulated door opening time in the present embodiment by viewing display unit 239. In this way, when the average door opening time is long, it is easy for the user to take a power saving action so as to be careful to reduce the average door opening time after that time.

The average door opening time directly relates to the start-up operation of compressor 208. For example, in a case where the frequency of door opening and closing by the user is high but the opening time per one opening is short, the load to compressor 208 is small. Therefore, the number of start-up of compressor 208 to operate is small. In addition, in a case where the accumulated door opening time is large and the opening time per one opening is short as well, the number of start-up of compressor 208 to operate is small.

Conversely, for example, in a case where the frequency of door opening and closing by the user is low but the opening time per one opening is long, compressor 208 certainly starts to operate. Particularly, in a case of freezing room 205 or vegetable room 206 where a drawer-type door is provided, all the foods in the refrigerator is pulled out and exposed to the outside of refrigerator 2100 by opening the drawer-type door. For this reason, if the door is opened for a long time, external warm air flows into the pulled-out freezing room 205 or vegetable room 206, and the temperature of the food increases, which results in the increase of the load on compressor 208. As a result, not only do compressor 208 starts to operate, but also the operation time thereof becomes long, and thus, conversely, the power consumption increases rather than power saving.

Accordingly, the power saving effect is small when only the frequency of door opening and closing and the accumulated door opening time per one opening is notified. However, it is important to notify the user of the information for taking an action to reduce the door opening time per one opening, that is, the average door opening time, here.

As described above, by reducing the average door opening time, it possible to certainly reduce the operation time of compressor 208. By notifying the user of the average door opening time and urging the user to take an accurate power saving action, it is possible to improve the energy saving effect. Particularly, in a case of freezing room 205 or vegetable room 206 on which the drawer-type door is provided as described above, this may be linked to the larger energy saving effect.

According to the present embodiment, since the average door opening time per one opening can be notified, the user is urged to take an action for reducing the door opening time per one opening, and as a result, the power saving effect increases and it is possible to highly improve the energy-saving properties.

In this way, since the power saving action of the user is taking an action for reducing the door opening time per one opening, the user can promote the power saving without forcibly reducing the opportunities for taking the foods in and out, and thus, it is possible to achieve the energy saving while maintaining the usability.

In addition, in the present embodiment, the frequency of door opening and closing stored in door opening and closing frequency storage unit 225 can also be displayed together with the average door opening time. In this way, the user can be aware of the frequency of door opening and closing together with the average door opening time at the same time. Accordingly, the user can be urged to take a power saving action for reducing the frequency of door opening and closing as well, and thus, it is possible to improve the energy saving properties.

Furthermore, in addition to the average door opening time and the frequency of door opening and closing, the accumulated door opening time stored in door opening time storage unit 227 can also be displayed. In this way, the user can be aware of the accumulated door opening time per one day as well, and can take a power saving action for reducing the accumulated door opening time itself, and thus, it is possible to further improve the energy saving properties.

In addition, in the present embodiment, since previous day data holding unit 230 that stores the average door opening time of the previous day is provided, display unit 239 can display the average door opening time while performing the comparison with that of the previous day. In this way, the user can accurately know the average door opening time compared with the previous day, and the above fact can be certainly linked to the power saving action, and thus it is possible to promote the energy saving.

In addition, as described above, display unit 239 displays at least any one of the frequency of door opening and closing and accumulated door opening time. Accordingly, in addition to the average door opening time, the user can accurately know at least one of the frequency of door opening and closing data and the accumulated door opening time data with compared with the previous day. In comparison with a case of solely displaying the average door opening time, this case is certainly linked to the power saving action, and thus, it is possible to promote the energy saving.

Furthermore, in the present embodiment, the communication system is constructed by mobile terminal 222 that includes display unit 239 such as a mobile phone and data transmission and receiving unit 221 that is capable of short distance data communication. Display unit 239 of mobile terminal 222 is used as displaying means for displaying the average door opening time. In this way, by causing mobile terminal 222 such as a mobile phone to approach data transmission and receiving unit 221, the user can cause the average door opening time or the like to be displayed on display unit 239 of mobile terminal 222, and can be aware of the average door opening time or the like. Accordingly, in refrigerator 2100 side, the display device can be removed to eliminate the power consumption for displaying, and thus, it is possible to further reduce the power consumption of refrigerator 2100 itself.

In addition, in the present embodiment, short distance communication detection unit 231 is provided on refrigerator 2100 side, and only in a case where short distance communication detection unit 231 detects the fact that the data is requested, data transmission and receiving unit 221 induces the electricity and the data is transmitted. In this way, data transmission and receiving unit 221 does not consume the power and thus, it is possible to achieve further energy saving for whole information system 2150.

In addition, mobile terminal 222 is configured to be able to communicate with the Internet line, and the average door opening time can be displayed on the terminal device such as a personal computer connected to the Internet line. With the configuration like this, for example, it is possible to check at least one of the average door opening time, the frequency of door opening and closing and the accumulated door opening time using a personal computer at the company. In this way, the user can call children or a grandfather's attention at home to advance the power saving.

In the case of the configuration like this, by accumulating the information such as the average door opening time and frequency of door opening and closing/accumulated door opening time obtained via mobile terminal 222 in a server or the like on the Internet line, the information can also be displayed on display unit 239, displayed in rankings, displayed in comparison with the information in the past, or displayed in the form of comparing the information with the information such as the average door opening time and frequency of door opening and closing/accumulated door opening time of other homes. In addition, since each pieces of information can be accumulated in the server or the like on the Internet line, it is possible to realize the above-described configuration without increasing the memory capacity of refrigerator 2100 or without making the control sequence be complicate.

In refrigerator 2100 in the present embodiment, data transmission and receiving unit 221 is provided on door 211 of storage room which is at the highest position of refrigerator 2100, that is, provided on door 211 of uppermost storage room among a plurality of storage rooms. In this way, there is no such a failure occurring in the case of providing data transmission and receiving unit 221 on the doors located at the lower part, that is, a failure that when the door upper than the door on which data transmission and receiving unit 221 is provided is opened, the cooling air leaks, falls down and contacts data transmission and receiving unit 221, and thereby the condensation occurs on the surface of data transmission and receiving unit 221, and thus, the communication state deteriorates and the component reliability decreases.

In addition, data transmission and receiving unit 221 is provided on door 211 which corresponds to refrigerating room 202 among a plurality of storage rooms. Since the temperature in refrigerating room 202 is higher than that in ice making room 203 or freezing room 205, it is possible to suppress the influence of the cooling air in the room on data transmission and receiving unit 221 to be small. That is, since the difference in temperature between the surface and the inner portion of data transmission and receiving unit 221 is suppressed to be small, and the occurrence of the condensation can be suppressed, it is possible to reduce the failure such as the deterioration of the communication state and the decrease of the component reliability.

In addition, data transmission and receiving unit 221 is incorporated into operation unit 218 provided at the end portion of right side door 211*b*. In this way, even if the affixing of the sticker to door 211*b* performed by the user on a daily basis is performed at the center portion of the door, the risk of the communication failure caused by the sticker which covers the surface of data transmission and receiving unit 221 can be reduced, and it is possible to certainly secure the communication performance.

In addition, since data transmission and receiving unit 221 is provided on right side door 211*b* having the larger size among double-door type doors 211 of the storage room. In this way, it is possible to reduce the occurrence of the failure in data transmission and receiving unit 221 due to the cooling air in the refrigerating room. There are many right-handed users and the frequency of the opening and closing right side door 211*b* by the right-handed user is high. In a case where right side door 211*b* is opened and the cooling air in the refrigerating room leaks out, there is a high possibility that the cooling air diffuses on the surface of left side door 211*a* at the opposite side of right side door 211*b*, and thus, the possibility that the cooling air goes around into the surface side of right side door 211*b* (data transmission and receiving unit 221 installed side) which is the rear side seen from the leaked cooling air, is very low. Therefore, there is almost no possibility that the cooling air contacts data transmission and receiving unit 221 provided on right side door 211*b*, and it is possible to suppress the failure such as the deterioration of the communication state and the decrease of the component reliability due to the condensation occurring on the surface of data transmission and receiving unit 221. When the door having a larger size is opened, the more cooling air leaks out.

On right side door 211 of the storage room, on which data transmission and receiving unit 221 is provided, corresponding automatic door opening and closing mechanism 217 is provided. Moreover, data transmission and receiving unit 221 is disposed at the position separated from handle portions 216 respectively provided on doors 211 to 215 and the position higher than handle portion 216. In this way, even if the user touches door 211*b* with the wet hand, the amount of water drops on the wet hand attaching to door 211*b* is small, and since handle portion 216 is separated from data transmission and receiving unit 221, data transmission and receiving unit 221 does not get wet due to the water drops, and thus, it is possible to reduce the failure such as the deterioration of the communication state and the decrease of the component reliability.

Sixth Embodiment

Next, a sixth embodiment of the present invention will be described.

Figure 22:
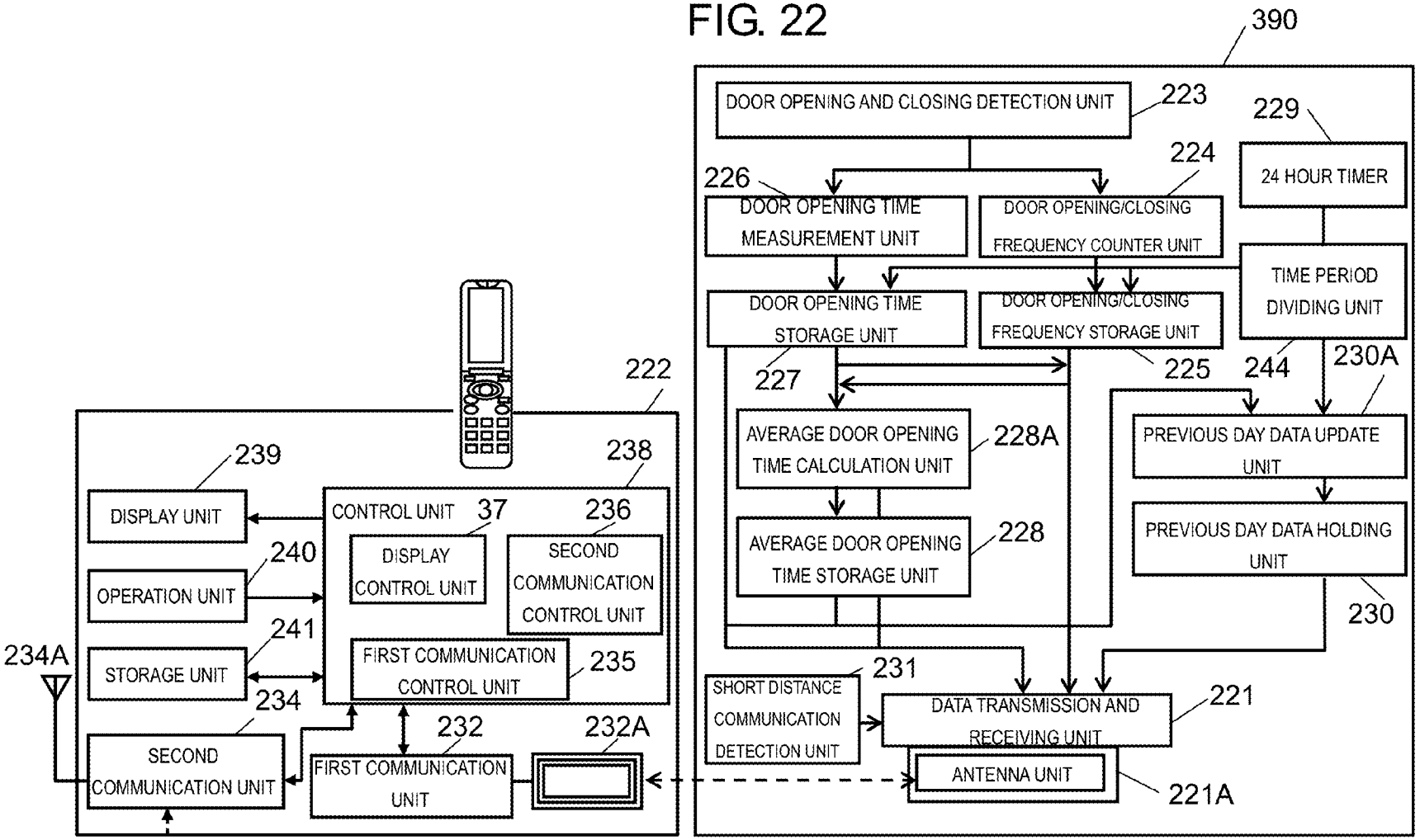
FIG. 22 is a functional block diagram illustrating configurations of a refrigerator control unit of a refrigerator and a mobile terminal in a sixth embodiment of the present invention.

FIG. 22 is a functional block diagram illustrating a configuration of refrigerator control unit 390 of a refrigerator and mobile terminal 222 in a sixth embodiment of the present invention.

In the present embodiment, the components common to those of refrigerator control unit 290 of refrigerator 2100 in the fifth embodiment will be referenced by the same numeral numbers, and the descriptions thereof will be omitted.

As illustrated in FIG. 22, refrigerator control unit 390 is different from refrigerator control unit 290 in the fifth embodiment in the point that refrigerator control unit 390 includes time period dividing unit 244.

Time period dividing unit 244 divides the time into a plurality of time periods based on the time output from 24 hour timer 229. Time period dividing unit 244 divides the time into four time periods such as breakfast, lunch, dinner, and sleeping.

Door opening and closing frequency storage unit 225, door opening time storage unit 227, and average door opening time storage unit 228 respectively store the frequency of door opening and closing, accumulated door opening time, and average door opening time for each time period divided by time period dividing unit 244.

The time period can be set as, for example, breakfast (06:00 to 11:00), lunch (11:00 to 16:00), dinner (16:00 to 23:00), and sleeping (23:00 to 06:00), but the above is an example, and the setting can be changed. If the user can set the time, it is possible to improve the usability.

According to the present embodiment, for each time period, for example in a case of breakfast time period, the user can accurately ascertain the frequency of door opening and closing, accumulated door opening time, and average door opening time, during the breakfast time period. In this way, the user can accurately ascertain whether the frequency of door opening and closing, accumulated door opening time, and average door opening time of him/herself during the breakfast time period is long or short. Furthermore, it is possible to know the data in comparison with that of the previous day. By displaying the data of the day and the previous day during the same time period, the user can accurately ascertain the increase or decrease of the data during the same time period in comparison with the data of the previous day, and thus, it is possible to take an effective power saving action.

That is, the user can accurately know the average door opening time in accordance with his/her diet pattern. For example, by comparing the average door opening time during the breakfast time period with that during the same time period of the previous day, the user can accurately know the increase or decrease of the average door opening time. In this way, the consciousness of reducing the average door opening time is effectively exerted, and it can be linked to the careful power saving action of the user. Therefore, it is possible to promote the energy saving.

Seventh Embodiment

Next, a seventh embodiment of the present invention will be described.

Figure 23A:
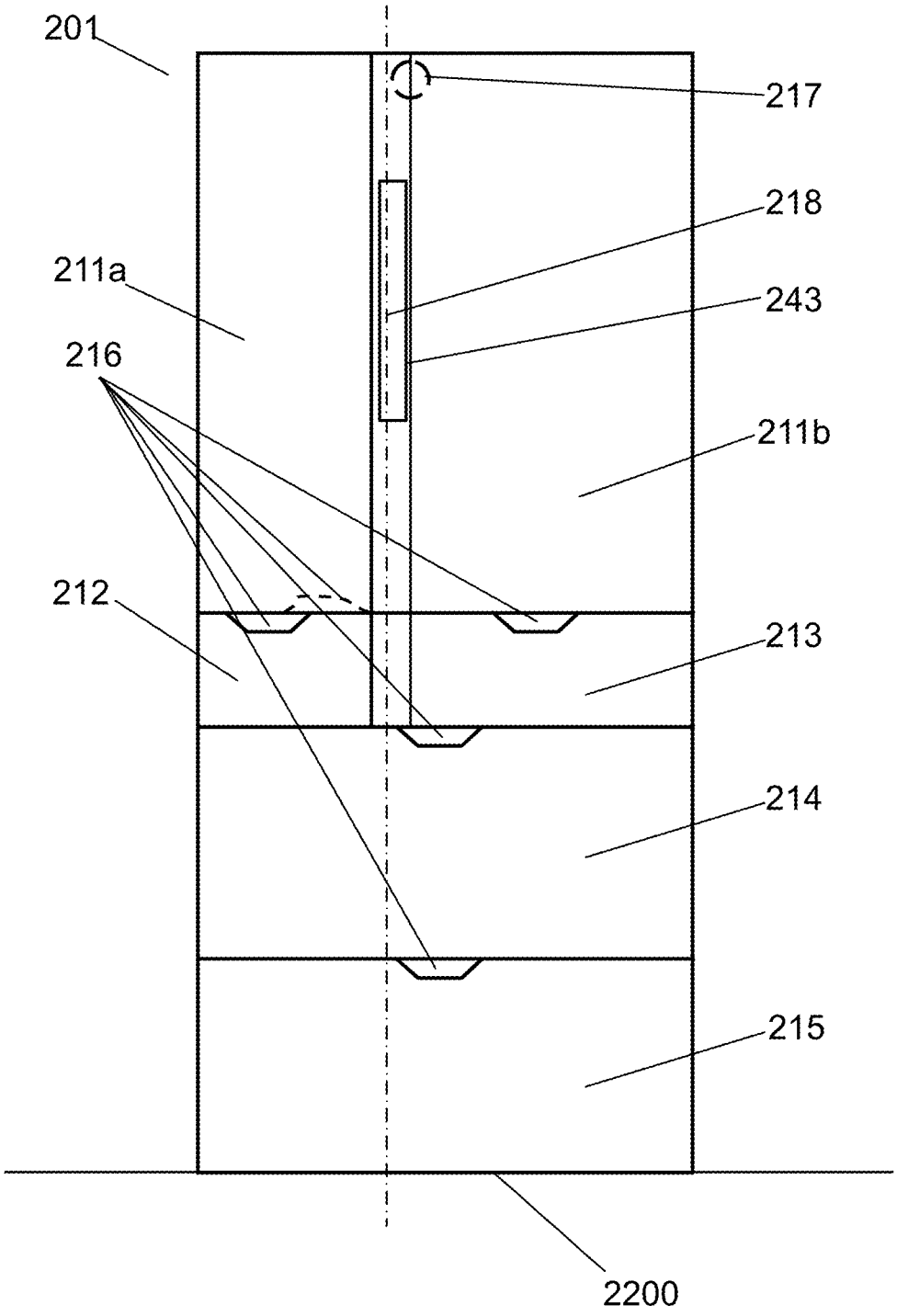
FIG. 23A is a plan view illustrating a configuration of a refrigerator in a seventh embodiment of the present invention.

FIG. 23A is a front view illustrating a configuration of refrigerator 2200 in a seventh embodiment of the present invention. In addition, FIG. 23B is a functional block diagram of refrigerator control unit 2190 of refrigerator 2200.

In the present embodiment, the components common to those of refrigerator 2100 in the fifth embodiment will be referenced by the same numeral numbers, and the descriptions thereof will be omitted.

As illustrated in FIG. 23A, in refrigerator 2200, display unit 243 is provided on door 211*b* of refrigerator body 201. Other configuration are the same as that in the fifth embodiment and the description thereof will be omitted.

Figure 23B:
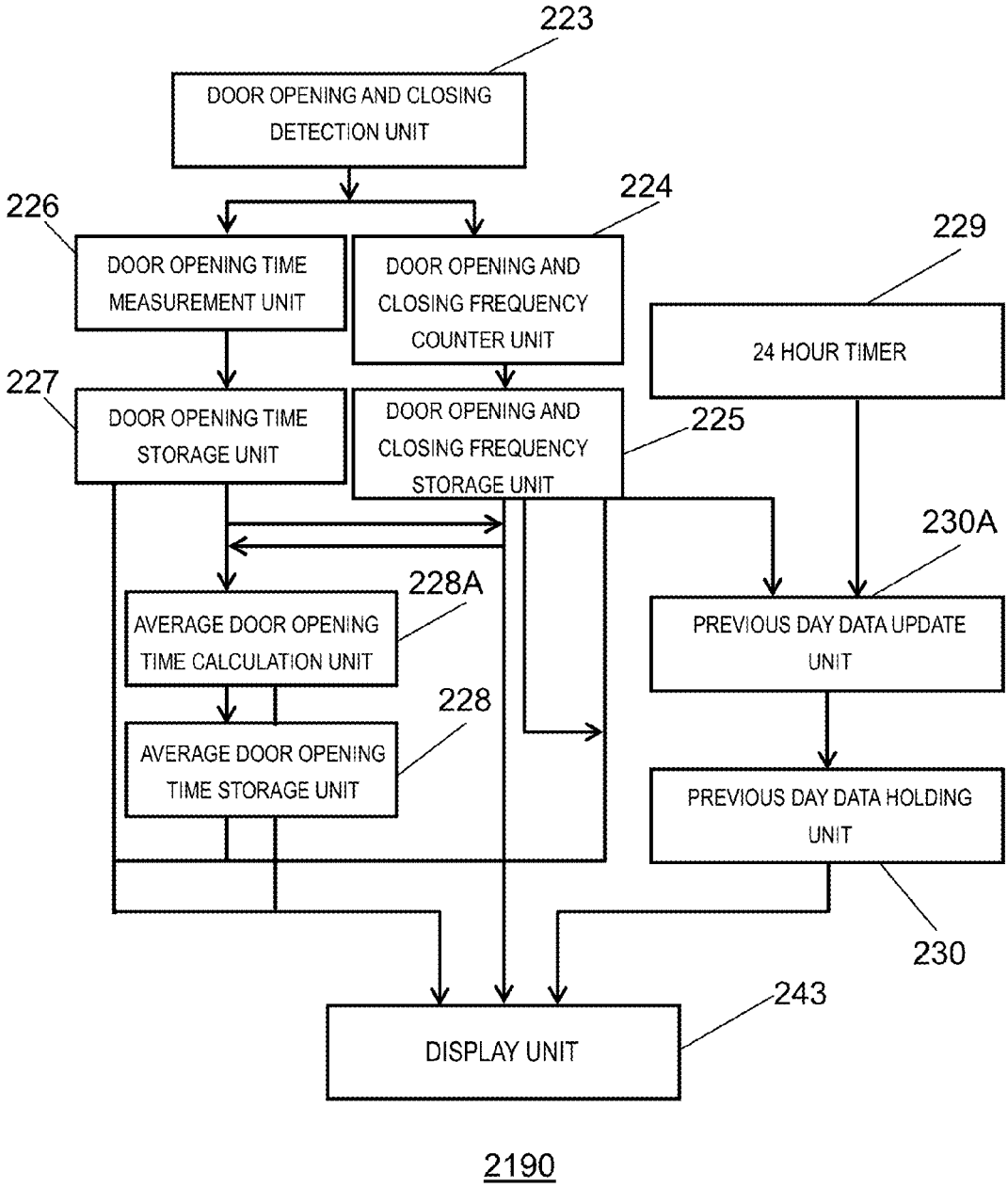
FIG. 23B is a functional block diagram illustrating a configuration of a refrigerator control unit of the refrigerator in the seventh embodiment of the present invention.
Figure 24:
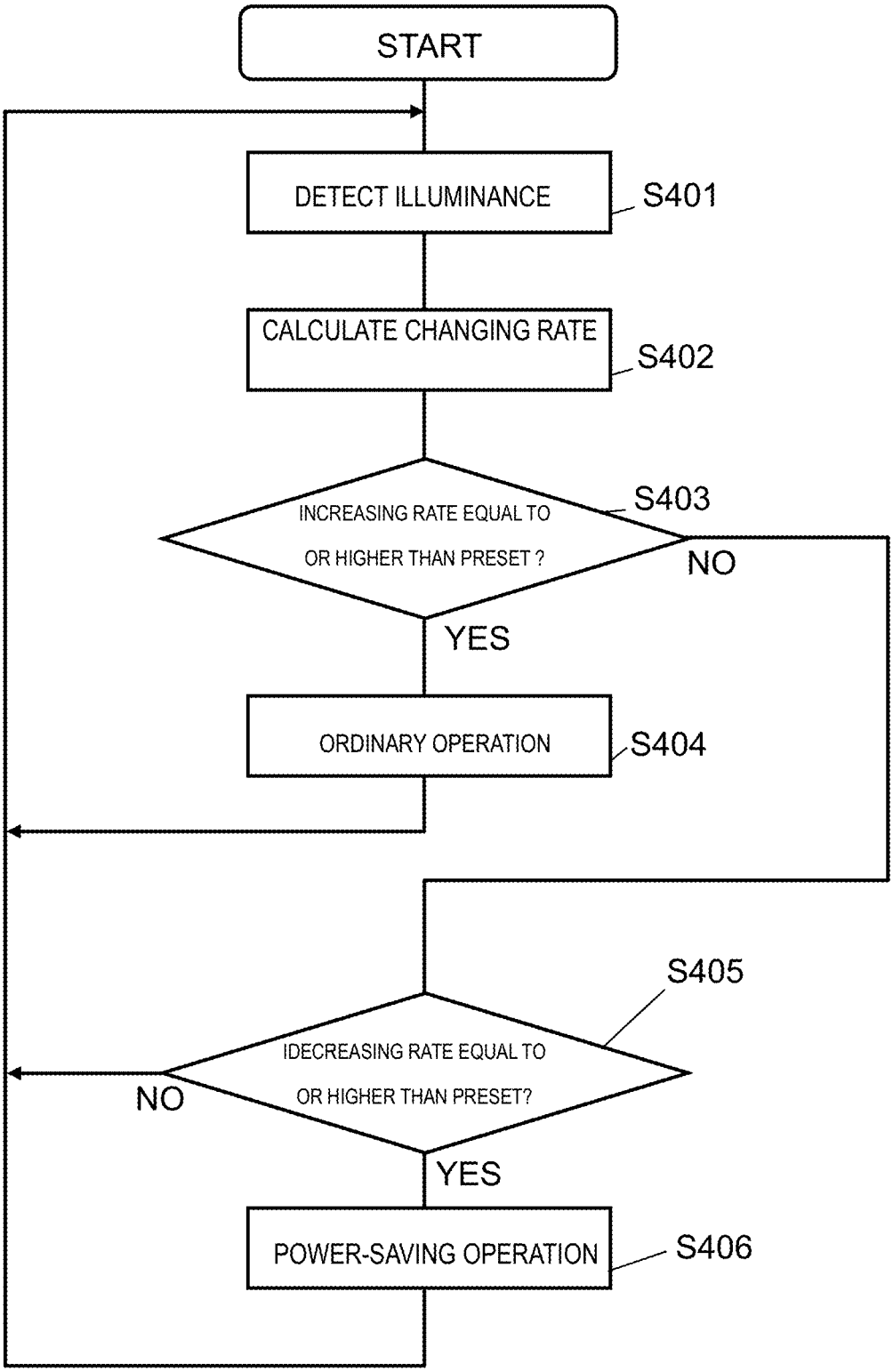
FIG. 24 is a flow chart for explaining a control of a refrigerator in the related art.

As illustrated in FIG. 23B, in refrigerator 2200 in the present embodiment, the configuration of refrigerator control unit 2190 is different compared to refrigerator 2100 in the fifth embodiment.

Specifically, refrigerator control unit 2190 includes short distance communication detection unit 231, data transmission and receiving unit 221, and antenna unit 221A. On the other hand, refrigerator control unit 2190 includes display unit 243.

In the present embodiment as well, as similar to refrigerator 2100 in the fifth embodiment, the user can be aware of the average door opening time by viewing display unit 243. When the average door opening time is long, it is easy for the user to take a power saving action so as to be careful to reduce the average door opening time after that time and take a power saving action. Therefore, the energy saving can be promoted.

Of course, in the sixth embodiment described above also, display unit 243 may be provided on refrigerator body 201 as similar to this seventh embodiment.

As described above, in refrigerator 2200 in the present embodiment also, since the user can be aware of the average door opening time directly linked to the operation of compressor 208, it is possible to accurately promote the energy saving. However, refrigerator 2200 in the embodiment described above is one aspect for realizing the present invention, and various modifications can be made within the objective scope of the present invention.

For example, in the embodiment described above, a notification to the user for the power saving education is performed by displaying. However, the present invention is limited to this example. For example, the notification can be performed by a voice or the like. In addition, the data notified to the user are the average door opening time and both of the frequency of door opening and closing and the accumulated door opening time. However, any one of the frequency of door opening and closing and the accumulated door opening time may be notified.

In addition, in the embodiment described above, the transmission function of data transmission and receiving unit 221 is described. However, an application can be considered, in which, for example, using the receiving function, a set temperature data is transmitted to data transmission and receiving unit 221 from mobile terminal 222 side, and the temperature in the refrigerator can be changed.

Furthermore, as an example of using the transmission and receiving function of data transmission and receiving unit 221, there may be a configuration of causing data transmission and receiving unit 221 on the door to also serve as door opening and closing detection unit 223. In this way, the configuration can be simplified. It is preferable for door opening and closing detection unit 223 to be provided on all of doors 211 to 215, however, may be appropriately provided on one or some doors of which the frequency of opening and closing is high.

INDUSTRIAL APPLICABILITY

As described above, according to the present invention, it is possible to achieve a special effect in which a user can be aware of the rate of an energy-saving operation performed by a refrigerator itself, and by increasing a rate of the energy-saving operation of the refrigerator itself, the energy saving can be achieved by the user. Accordingly, the present invention is useful to a refrigerator, particularly to a refrigerator with high energy-saving properties, and an information system in which the refrigerator is used.

REFERENCE MARKS IN THE DRAWINGS

1, 101, 201 refrigerator body
1*a*, 101*a*, 201*a* outer box
1*b*, 101*b*, 201*b* inner box
1*c*, 101*c*, 201*c* rigid polyurethane foam
1*d*, 101*d*, 201*d* vacuum heat insulating material
2, 102, 202 refrigerating room
3, 103, 203 ice making room
4, 104, 204 temperature switching room
5, 105, 205 freezing room
6, 106, 206 vegetable room
7, 107, 207 machine room
8, 108, 208 compressor
9, 109, 209 cooler
10, 110, 210 cooling fan
11 to 15, 11*a*, 11*b*, 111 to 115, 111*a*, 111*b*, 211 to 215, 211*a*, 211*b* door
16, 116, 216 handle portion
17, 117, 217 automatic door opening and closing mechanism
18, 118, 218 operation unit
19 illuminance sensor
20 human sensor
21, 119, 219 setting switch
22, 120, 220 setting status display unit
24 energy-saving operation unit
25, 125, 223 door opening and closing detection unit
26 external air temperature sensor
27 internal temperature sensor
28 temperature compensation heater
29 internal lighting
31, 121 data transmission unit
31A, 121A, 221A antenna unit
32, 122, 222 mobile terminal
33 time measurement unit
34 energy-saving operation rate calculation unit
35 energy-saving operation rate/time storage unit
36 door opening and closing counter unit
37 door opening and closing storage unit
38, 127, 229 24 hour timer
38A clock
39, 130, 230A previous day data update unit
40, 130A, 230 previous day data holding unit
41, 131, 231 short distance communication detector
42, 132, 232 first communication unit
43, 44A, 133, 134A, 232A, 234A antenna

44, 134, 234 second communication unit
45, 135, 235 first communication control unit
46, 136, 236 second communication control unit
47, 137, 237 display control unit
48, 138, 238 control unit
49, 53, 139, 143,239,243 display unit
50, 140, 240 operation unit
51, 93, 141, 241 storage unit
54, 128, 244 time period dividing unit
90, 190,290, 390, 1090, 1190, 2190 refrigerator control unit
100, 200, 1100, 1200, 2100, 2200 refrigerator
126 frequency counter unit
129 frequency storage unit
150, 1150, 2150 information system
221 data transmission and receiving unit
224 door opening and closing frequency counter unit
225 door opening and closing frequency storage unit
226 door opening time measurement unit
227 door opening time storage unit
228 average door opening time storage unit
228A average door opening time calculation unit

The invention claimed is:

1. A refrigerator comprising:

an energy-saving operation unit that performs a control for performing a power saving operation;

a time measurement unit that measures an operation time of the energy-saving operation unit;

an energy-saving operation rate calculation unit that calculates an energy-saving operation rate based on the operation time measured by the time measurement unit; and an energy-saving operation rate storage unit that stores the energy-saving operation rate calculated by the energy-saving operation rate calculation unit, wherein the energy-saving operation rate calculation unit calculates the energy-saving operation rate per one day.

2. The refrigerator of claim 1, further comprising:

a data transmission unit that transmits the energy-saving operation rate stored in the energy-saving operation rate storage unit to an outside.

3. The refrigerator of claim 2, further comprising:

door provided corresponding to storage room;

a door opening and closing counter unit that detects a frequency of opening and closing or opening time of the door; and a door opening and closing storage unit that stores the frequency of opening and closing or the opening time of the door detected by the door opening and closing counter unit, wherein the data transmission unit transmits the energy-saving operation rate stored in the energy-saving operation rate storage unit and the frequency of opening and closing or the opening time of the door stored in the door opening and closing storage unit.

4. The refrigerator of claim 3, further comprising:

a previous day data holding unit that stores at least any one data item of previous day among the energy-saving operation rate, and the frequency of opening and closing or the opening time, wherein the data transmission unit transmits at least the data of the previous day, and at least any one data item of the day among the energy-saving operation rate, and the frequency of opening and closing or the opening time.

5. The refrigerator of claim 1, further comprising:

a display unit that displays the energy-saving operation rate stored in the energy-saving operation rate storage unit.

6. The refrigerator of claim 5, comprising:

door provided corresponding to storage room;

a door opening and closing counter unit that detects a frequency of opening and closing or opening time of the door; and a door opening and closing storage unit that stores the frequency of opening and closing or the opening time of the door detected by the door opening and closing counter unit, wherein the display unit displays the energy-saving operation rate stored in the energy-saving operation rate storage unit and the frequency of opening and closing or the opening time of the door stored in the door opening and closing storage unit.

7. The refrigerator of claim 6, further comprising:

a previous day data holding unit that stores at least any one data item of previous day among the energy-saving operation rate, and the frequency of opening and closing or the opening time, wherein the display unit displays at least the data of the previous day, and at least any one data item of the day among the energy-saving operation rate, and the frequency of opening and closing or the opening time.

8. An information system comprising:

a mobile terminal having a display unit; and the refrigerator of claim 2, wherein the mobile terminal displays an information sent from the data transmission unit of the refrigerator on the display unit.

9. An information system comprising:

a mobile terminal having a display unit; and the refrigerator of claim 3, wherein the mobile terminal displays an information sent from the data transmission unit of the refrigerator on the display unit.

10. An information system comprising:

a mobile terminal having a display unit; and the refrigerator of claim 4, wherein the mobile terminal displays an information sent from the data transmission unit of the refrigerator on the display unit.

* * * * *